US010032370B2

(12) United States Patent
Tummala et al.

(10) Patent No.: US 10,032,370 B2
(45) Date of Patent: Jul. 24, 2018

(54) METHODS AND APPARATUS FOR ENABLING MOBILE COMMUNICATION DEVICE BASED SECURE INTERACTION FROM VEHICLES THROUGH MOTION SIGNATURES

(71) Applicant: Honda Motor Co., Ltd., Tokyo (JP)

(72) Inventors: Gopi Krishna Tummala, Columbus, OH (US); Derrick Ian Cobb, Columbus, OH (US); Prasun Sinha, Columbus, OH (US); Rajiv Ramnath, Columbus, OH (US)

(73) Assignee: HONDA MOTOR CO., LTD., Tokyo (JP)

( * ) Notice: Subject to any disclaimer, the term of this patent is extended or adjusted under 35 U.S.C. 154(b) by 259 days.

(21) Appl. No.: 15/060,494

(22) Filed: Mar. 3, 2016

(65) Prior Publication Data

US 2016/0260324 A1 Sep. 8, 2016

Related U.S. Application Data

(60) Provisional application No. 62/275,163, filed on Jan. 5, 2016, provisional application No. 62/127,695, filed on Mar. 3, 2015.

(51) Int. Cl.
*G08G 1/017* (2006.01)

(52) U.S. Cl.
CPC ..... *G08G 1/0175* (2013.01)

(58) Field of Classification Search
USPC ..... 348/148
See application file for complete search history.

(56) References Cited

U.S. PATENT DOCUMENTS

| | | | | |
|---|---|---|---|---|
| 5,420,794 | A * | 5/1995 | James | G08G 1/096716 340/932 |
| 9,235,988 | B2 * | 1/2016 | Mimeault | G01S 17/58 |
| 9,378,640 | B2 * | 6/2016 | Mimeault | G01S 17/023 |
| 2006/0064345 | A1 * | 3/2006 | Biet | G07B 15/063 705/13 |
| 2009/0174575 | A1 * | 7/2009 | Allen | G07B 15/063 340/933 |
| 2015/0045929 | A1 * | 2/2015 | Lee | G05B 19/402 700/114 |

* cited by examiner

*Primary Examiner* — Christopher Findley
(74) *Attorney, Agent, or Firm* — Kenealy Vaidya LLP

(57) ABSTRACT

Some embodiments are directed to a computer-assisted method for identifying a vehicle. The computer-assisted method can include: receiving, from a stationary sensor, sensor data representing a plurality of moving vehicles; receiving, from a particular vehicle, a communication including sensor data representing the particular vehicle, wherein the sensor data includes at least one of velocity and position for the particular vehicle; and identifying, from the sensor data representing a plurality of moving vehicles, a subset of the data representing the particular vehicle, wherein identifying the subset of data comprises analyzing the sensor data received from the stationary sensor in conjunction with the sensor data received from the particular vehicle.

20 Claims, 19 Drawing Sheets

METHODS AND APPARATUS FOR ENABLING MOBILE COMMUNICATION DEVICE BASED SECURE INTERACTION FROM VEHICLES THROUGH MOTION SIGNATURES

CROSS REFERENCE TO RELATED APPLICATIONS

This application is non-provisional of U.S. Provisional Patent Application Nos. 62/275,163, and 62/127,695, filed on Jan. 5, 2016, and Mar. 3, 2015, respectively. The content of U.S. Provisional Patent Application Nos. 62/275,163, and 62/127,695 are hereby incorporated by reference in their entireties.

BACKGROUND

The disclosed subject matter relates to methods and apparatus for enabling secure wireless transactions. In particular, some embodiments are directed to mobile communication device, such as a smartphone, based secure interactions from vehicles through motion signatures.

Mobile communication device based payments have become more common, as evidenced by the increasing popularity of mobile payment systems, such as Google Wallet and Apple Pay. Some banks, such as MasterCard and Visa, work closely with a number of mobile device developers to make this technology more widely available. In these applications, a transaction takes place between two objects as the two objects momentarily come close to each other for a short period of time, with relative proximity determining between which parties the conversation takes place. Reliability and usability are prime requirements for these applications.

Some implementations of these payment systems are based on related art Near-Field-Communication (NFC) technology that theoretically supports a range of up to 20 cm, but practically has been shown to only support a range of a few cm. Although initial versions of NFC were not secure, security of some related art systems is implemented at the application layer, which makes it possible to explore longer range wireless technologies, such as Bluetooth and WiFi, for these payment systems.

SUMMARY

By allowing communication from a greater distance, the service time of a customer, i.e., an individual for whom a transaction is being processed, can be reduced (and in some cases significantly reduced) in many application scenarios, including but not limited to applications with interactions originating from within a vehicle. Such applications can be categorized as vehicle-specific services, wherein payment for services, such as a car-wash, automated fueling, automated swapping of car batteries for Electric Vehicles (EVs), automated battery charging centers for EVs, and parking charges are made from within the vehicle. For example, in an auto manufacturing plant, a vehicle arriving at a manufacturing station needs to be correctly identified so that the appropriate set of tests can be conducted, and so that the appropriate actions can be taken by assembly line robots or humans. Applications can also be categorized as user-specific services, wherein payment for drive-through services, such as fast-food, or DVD rental can be supported by such a system. As another application, the system can enable a bank customer to perform automatic verification from inside the vehicle before reaching the ATM machine. However, the above vehicle and user specific services applications are merely provided for exemplary purposes, and embodiments are intended to be applicable in other contexts.

In these applications, a transaction takes place between two objects as the two objects momentarily come close to each other for a short period of time. Nearness also determines between which parties the conversation takes place. In other words, object A is transacting with B, because B is the only object currently near A. Further, the core pattern is for the transaction to be initiated when one object comes close to the other, and terminated when the objects move apart. The communication range can be leveraged to determine the "nearness"—that is, the range—at which the transaction takes place. In other words, when A can hear B, they must be close and the transaction can begin. When A can no longer hear B, then the transaction can end. Further, the short range of the technology eliminates other parties incorrectly being part of the transaction. That is, the short range is used to ensure that B is the only object close to A.

Two objects A and B would simply like to determine when they are near each other, and when they are not. They would also like to be sure that they are the "closest" and hence the correct and authorized two objects to be transacting with each other.

Performing transactions from within a vehicle may be beneficial by leading to shorter wait times and higher system throughput. Further, in many scenarios, a user may appreciate being exposed to inclement outside weather for a reduced duration. A challenge in performing interactions over a longer range wireless technology includes the accurate identification of the specific device to charge or interact with, from a large number of in-range devices. This procedure requires the correlating of an observed signal with its transmitting physical device.

Vehicular identification systems using RFID technology, such as E-Z Pass, FastTrack and I-PASS are widely used in toll-ways in the United States and abroad. These systems are subject to several inherent limitations in the context of toll collection as well as limitations that prevent generalized use for a wider class of applications, some of which are disclosed above.

For example, these systems are subject to limited accuracy. Related art toll systems are based on devices, such as cameras, RFIDs, laser sensors and inductive loops. Due to the transmission range of the tags on the vehicles, the signal can be picked up by multiple tollbooths leading to inaccurate charges and unhappy customers. These systems can also be subject to limited interaction capability. For example, the tags used in the vehicles typically do not include an interface to enable user input or to personalize the interaction (such as a PIN number needed for an ATM transaction). The systems can also have a hardware requirement on the user end. For example, the vehicle may need to have a device or sticker placed near the vehicle's windshield or dashboard. The involvement of an additional device at the user end limits its flexibility.

Location information obtained through GPS can be used to improve or enhance the accuracy of such systems. The accuracy of GPS in mobile communication devices range from a few meters to tens of meters, and disposition proximate near large buildings and concrete structures can negatively affect functionality. Thus, this technology may not be well suited for satisfying the high-accuracy needs of at least some of the above applications.

Thus, it may be beneficial to provide a mobile communication device based secure interaction system to be used in vehicles for use in at least one of the above contexts, which is referred to herein as Soft-Swipe. Some embodiments use one or more self-generated natural signatures, such as but not limited to motion signatures, which can be reported by the target object matched with the same signature detected by instrumentation of the environment. Some embodiments use inertial sensors in the mobile communication device to obtain a motion signature of the vehicle. This signature is transmitted with other credentials in a secure fashion to the infrastructure, such as over Bluetooth or WiFi. The infrastructure can use one or more video cameras and one or more sensors, such as motion detection sensors, attached to the infrastructure as a sensor array, to measure the motion signature, layered on commodity or specialized communication and sensing technology to identify when vehicle is close, the identity of the vehicle, and when the vehicle is no longer close. The correspondence between the motion signatures obtained from within the vehicle and from outside the vehicle is used to uniquely identify the vehicle(s).

Some of these embodiments are thereby able to provide high accuracy user identification. For example, the data from inertial sensors as well as measurements from external sensors capture motion signatures that are potentially unique to each vehicle, thus leading to high accuracy matching of lanes to vehicles. Some of these embodiments are also thereby able to provide application specific user interaction. For example, the application can securely load an application-specific screen to the user's mobile communication device to obtain input and confirmation, if needed. In addition, some of these embodiments are thereby able to provide instant deployment through mobile communication devices applications. For example, this system does not have any additional hardware requirement at the user side (which is contrary to the NFC hardware or Toll tags). As a result, the solution is immediately deployable by installing the application.

It may also be beneficial to address certain challenges in order to make Soft-Swipe robust and practically useful. For example, it may be beneficial for the system to quickly match the vehicles to the correct lanes with high accuracy. It may also be beneficial for the system to not require human intervention for training.

Some of the disclosed embodiments involve or otherwise include a self-learning based technique to extract the motion signature using cameras. In addition, some of the disclosed embodiments involve or otherwise include a robust technique to extract the motion signature using an array of motion sensors. A beneficial technique is also disclosed for rapid and high-accuracy matching of vehicles to lanes that uses multiple resolutions of motion signatures. Further, using real traces collected at an auto manufacturing plant, an extensive trace-driven evaluation can be performed to characterize the performance of Soft-Swipe.

It may further be beneficial to enable lane specific reliable pairing of vehicles with infrastructure. Some of the embodiments disclose or otherwise cover matching motion signatures generated from two types of sources. First, Soft-Swipe receives a signature from the object being serviced that can be tagged with the object's identity. This signature may be generated by a mobile communication device, such as a smartphone (hence mobile communication devices can be useful components of Soft-Swipe's architecture) or by a purpose-built device on the object. Next, Soft-Swipe can acquire signatures for the same object generated by external, location aimed devices, that is, devices that are targeted at the locus of interaction, such as a video camera whose field of view covers the targeted area. Note that these signatures are not tagged with the object's identity, because the external devices only know that there is an object in their field of view, but do not know which object it is. Finally, in some embodiments multiple sources (of either type) may be used to provide complementary or additive information. For example sources may include, but are not limited to, the external location-aimed sensing, cameras, ultra-sonic range sensors, or passive Infrared sensors, as well as LIDAR, RADAR and microwave technologies that do motion estimation by measuring Doppler shifts. Finally, electromagnetic sensing devices such as Inductive coils may be used to detect the presence of metallic bodies, and potentially their velocity as well.

It may therefore be beneficial to provide a system that, since closeness is not defined solely based on the communication range, is not directly subject to the vagaries of the communication technology. As only the infrastructure areas (of which there may be few) needs to be instrumented, which can be with commodity or specialized products, and not each vehicle (of which there may be many), the overall cost of deployment can be much lower. Finally, since a communication device in the vehicle can be programmed, it can be beneficial to personalize the interactions—such as by allowing the driver to provide additional input, providing status updates to the driver, etc.—as well as to instantly deploy the application and updates.

It can also be beneficial for the embodiments and their implementation(s) to recognize one or more of the following challenges. The system can advantageously quickly match the vehicles to the correct lanes with enhanced or high accuracy. The system can be relatively easy to set up and deploy, and not require significant human intervention for training and calibration. The system can be built from commodity components, in order to provide a lower cost of the components or can be built from purpose-built specialized components.

It can be further beneficial for the embodiments to provide a unique, self-learning, scheme for extracting motion signatures from cameras, present an innovative and robust technique for extracting motion signatures from an array of low-cost sensors, provide methods for fast matching of signatures, and/or show results from extensive evaluation using traces gathered from measurements taken in the real world.

Some embodiments are therefore directed to a computer-assisted method for identifying a vehicle. The computer-assisted method can include: receiving, from a stationary sensor, sensor data representing a plurality of moving vehicles; receiving, from a particular vehicle, a communication including sensor data representing the particular vehicle, wherein the sensor data includes at least one of velocity and position for the particular vehicle; and identifying, from the sensor data representing a plurality of moving vehicles, a subset of the data representing the particular vehicle, wherein identifying the subset of data comprises analyzing the sensor data received from the stationary sensor in conjunction with the sensor data received from the particular vehicle.

Some other embodiments are directed to a computer-assisted method for identifying a vehicle in a vehicle manufacturing lane. The computer-assisted method can include: receiving, from a camera, real-time images of a plurality of vehicle manufacturing lanes; receiving, from a particular vehicle, a communication including sensor data representing the particular vehicle and registration data identifying the particular vehicle, wherein the sensor data includes at least one of velocity and position for the particular vehicle;

estimating movement data associated with each of a plurality of vehicle images from the received camera real-time images of the vehicle manufacturing lanes; associating a particular vehicle image of the plurality of vehicle images with the registration data identifying the particular vehicle based on comparing the estimated movement data to the sensor data representing the particular vehicle; and associating a particular vehicle manufacturing lane with the registration data based on the particular vehicle image being associated with the registration data.

Still other embodiments are directed to a vehicle identification system for use with a plurality of vehicles each having a dynamic sensor therein, the dynamic sensors configured to record and transmit dynamic sensor data including at least one of velocity and position of the vehicle. The vehicle identification system can include a stationary sensor configured to record and transmit stationary sensor data representing each of the plurality of moving vehicles. The vehicle identification system can also include a processor configured to receive the dynamic sensor data from the dynamic sensor in each of the plurality of vehicles and the stationary sensor data of each of the plurality of vehicles from the stationary sensor, and identify subset of data representing a particular vehicle from the plurality of vehicles by analyzing and matching the dynamic sensor data and the stationary sensor data of the particular vehicle.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows.

I. Overview

Figure 1:
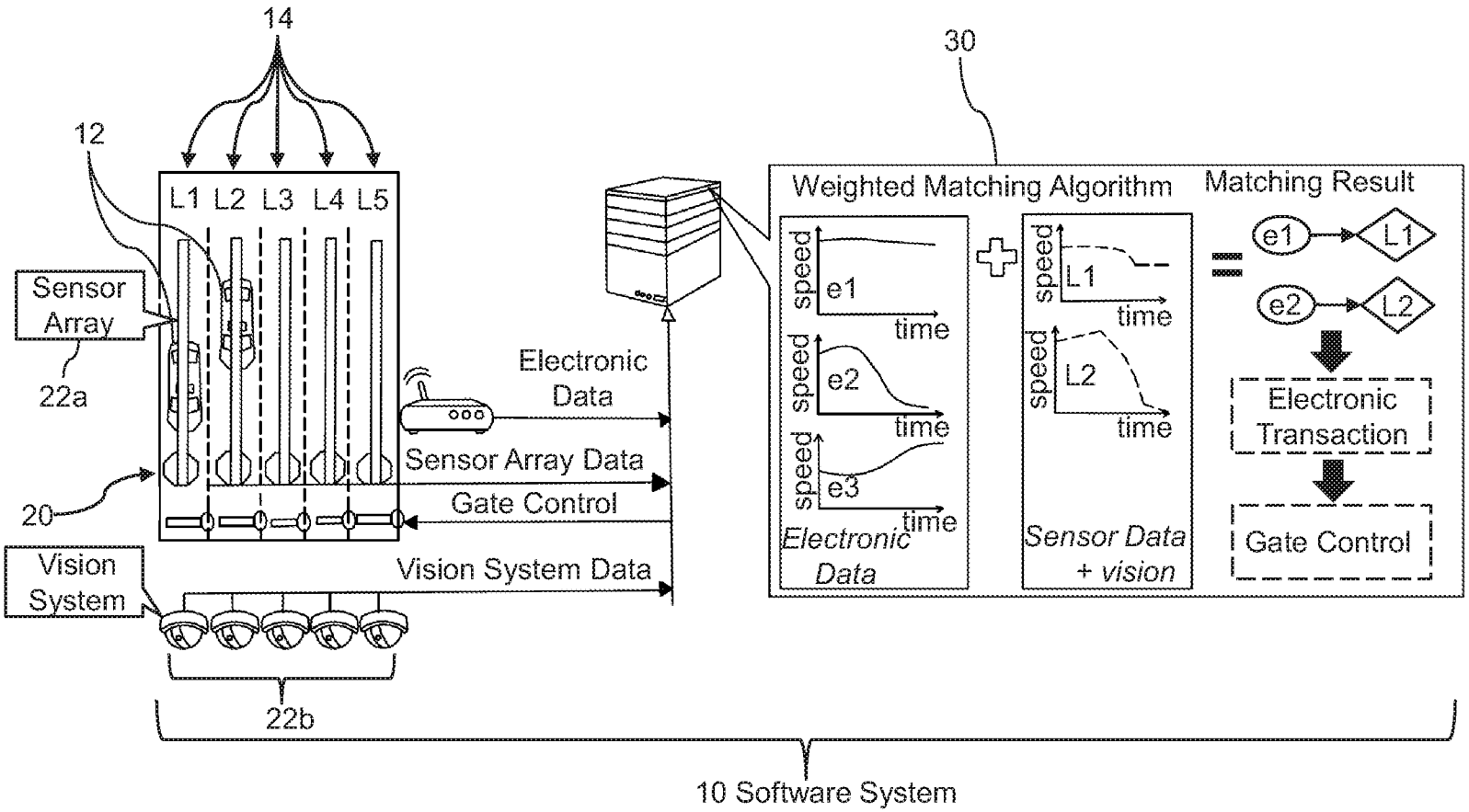
FIG. 1 is a schematic of an exemplary architecture of a system in accordance with the present disclosure.

FIG. 1 is a schematic of an exemplary architecture of a system in accordance with the present disclosure, i.e., an exemplary Soft-Swipe architecture. Soft-Swipe 10 may include two primary components. The first component is a sensing component 20 that uses a vision sensor array 22*b* or depth sensor array 22*a* to capture the motion profile of the vehicles 12. The second component is a matching algorithm 30 that takes the motion signatures from different vehicles 12 and multiple lanes 14, and matches vehicles 12 to corresponding lanes 14. The sensing and matching occurs automatically as the vehicles 12 enter and leave the station. Sensing can be performed by either using commodity cameras or by using a sensor array.

FIG. 1 shows an embodiment of the architecture of Soft-Swipe system 10 where the internal signature is generated by a service device in the vehicle 12. The external, location-aimed signatures are generated from two sources: (a) a video camera 23*b* aimed at the service lane 14 and (b) an array of depth sensors 22*a* above and parallel to the service lane 14. The exemplary Soft-Swipe system 10 uses the two types of signatures in two important ways. First, during system initialization, these signatures are used to calibrate one or more external sensing components 22*a,b*. This allows these devices 22*a,b* to properly convert the phenomena they detect (such as, a series of images, or the distance between where the sensor array 22*a* is mounted and a planar surface of the automobile) into motion signatures.

When the exemplary system 10 is in operation, the generated signatures from the vision system 22*b* and sensors 22*a* are combined adaptively for a more accurate motion signature, as described below. An accurate motion signature can be obtained and sent to centralized server-side signature matching component. The matching component can match the external motion signatures to the internal motion signature that contains the identity of the object described below. When proper matching occurs, Soft-Swipe 10 can identify the moving object in the sensing field of view, and by definition in the systems proximal locus of interaction.

Figure 2:
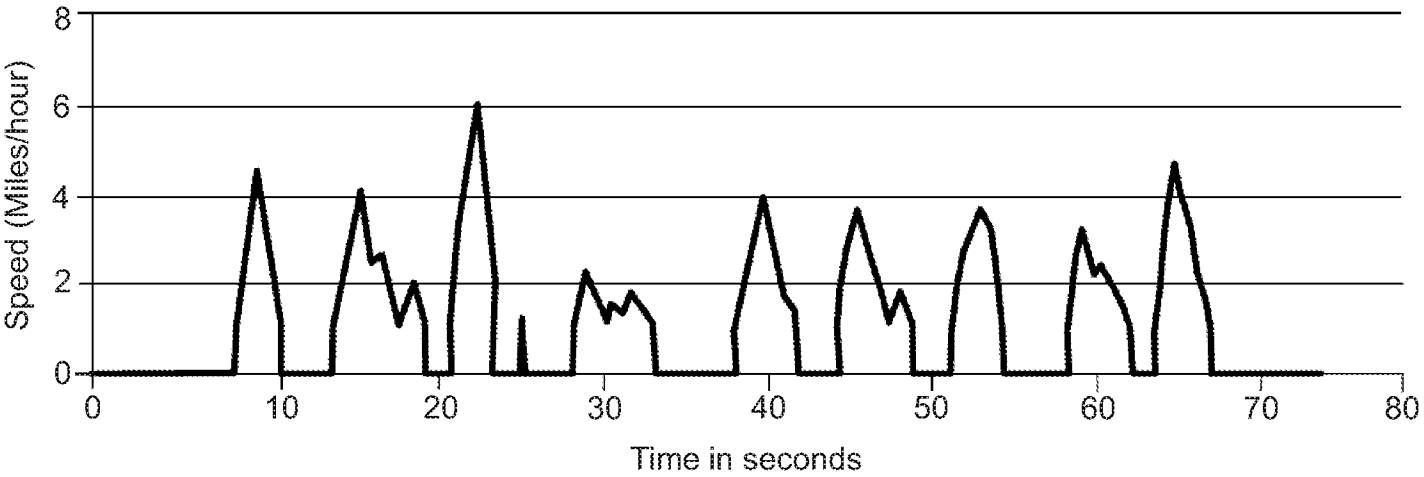
FIG. 2 is a graph showing the measuring of the speed of vehicles entering and leaving a vehicle service station in accordance with the present disclosure.

FIG. 2 is a graph showing the measuring of the speed of vehicles 12 entering and leaving a vehicle service station in accordance with the present disclosure, i.e., the speed of vehicles 12 entering and leaving is measured at a vehicle service station.

Soft-Swipe 10 enables economic vehicular NFC by distinguishing vehicles 12 and matching them to corresponding lanes 14 using motion profiles. In order to distinguish vehicles 12, the system 10 estimates the speed of a vehicle 12 in a given lane 14 accurately, and matches the vehicle speed with velocities from different broadcasts. In addition, the system 10 follows the given design objectives to enable a wide range of vehicular NFC applications.

Some embodiments involve the sensing of variable speed. For example, the sensing system 22*a* or 22*b* measures a wide range of speeds accurately. FIG. 2 plots speed of different vehicles 12 entering and leaving measured at a service station. These speeds can be in the order of a few M/h and change at a high-rate.

Some embodiments also perform sensing in dense environments. For example, the sensing system 22*a* or 22*b* distinguishes vehicles 12 in a dense environment that are very close, i.e., within a few feet of each other. As shown in FIG. 1, the inter-vehicle time is less than a few seconds, indicating high-vehicle density in a service station. The system also filters-out noise caused by random human movements across lanes 14 and their neighborhood.

Some embodiments focus on usability. Highly accurate speed sensing may be provided at economic cost, and without (or a reduced) system training requirement. It may be beneficial for the system 10 to be easily deployable and portable so as to be movable from one place to another.

II. Challenges

Certain challenges may need to be addressed to implement the disclosed systems, including but not limited to: clock off set, a low sampling rate, a vision system lacking depth information, sensing variable speeds, and filtering unrelated vehicles.

III. Disclosed System

A. Trace the Line: Motion from Vision

Some embodiments involve extracting a motion profile from vision. A significant challenge in extracting motion from vision involves the fact that cameras lack depth information. Thus, the speed observed in the camera plane (camera frame) is a projection of actual speed.

Vehicle motion profile estimation from vision can be broadly classified into the following two categories: moving vehicle, and traffic camera. With regard to the moving vehicle, the motion of neighboring vehicles is estimated by using the length of known shapes on a road. Lane markers on a freeway have a fixed length (e.g., 3 foot) and have a gap, e.g., 9 foot gap, between the lane markers. With the length of the lane markers, the time taken to traverse this length is used to estimate speed.

With regard to traffic cameras, road side cameras use the information, such as camera-mount angle and the dimensions of the road, to estimate the speed of the vehicle. The system is trained to match the motion observed from the camera to real-motion on the road, which is used to measure speed.

The above approaches are designed to estimate the speed of vehicles in a traffic scenario. These schemes may not be consistent with the design objectives of some of the disclosed embodiments for a variety of reasons. With regard to required training, the above techniques require usage of either the dimensions of real world objects or the dimensions of the road, which may not be employed for some of the disclosed embodiments. In indoor environments, objects often move, and the dimensions of the lanes change frequently. By employing the above approaches, training is required with small changes in the environment. With regard to robustness, distinguishing noise and unwanted movement is not achieved in the above approaches. Human movement inside the car and on the lane is very frequent, which must be filtered to accurately estimate motion profile.

Soft-Swipe 10 uses the motion signatures observed from the vehicle transmission to self-train the system and design a noise filter to reduce or eliminate noise in the environment. The user merely needs to place the camera covering all the lanes 14, and start using the system 10. The self-training algorithm 30 reduces or eliminates the cumbersome training of the system 10 whenever some change in the environment or lanes 14 occurs. Since all of the vehicles 12 entering the lane 14 follow the same route, Soft-Swipe 10 uses historic information to design a filter along the lane 14 direction. This noise-filter captures the speed in one direction, thereby reducing or eliminating noise caused by someone sitting inside the vehicle 12, and noise in the environment.

Figure 3:
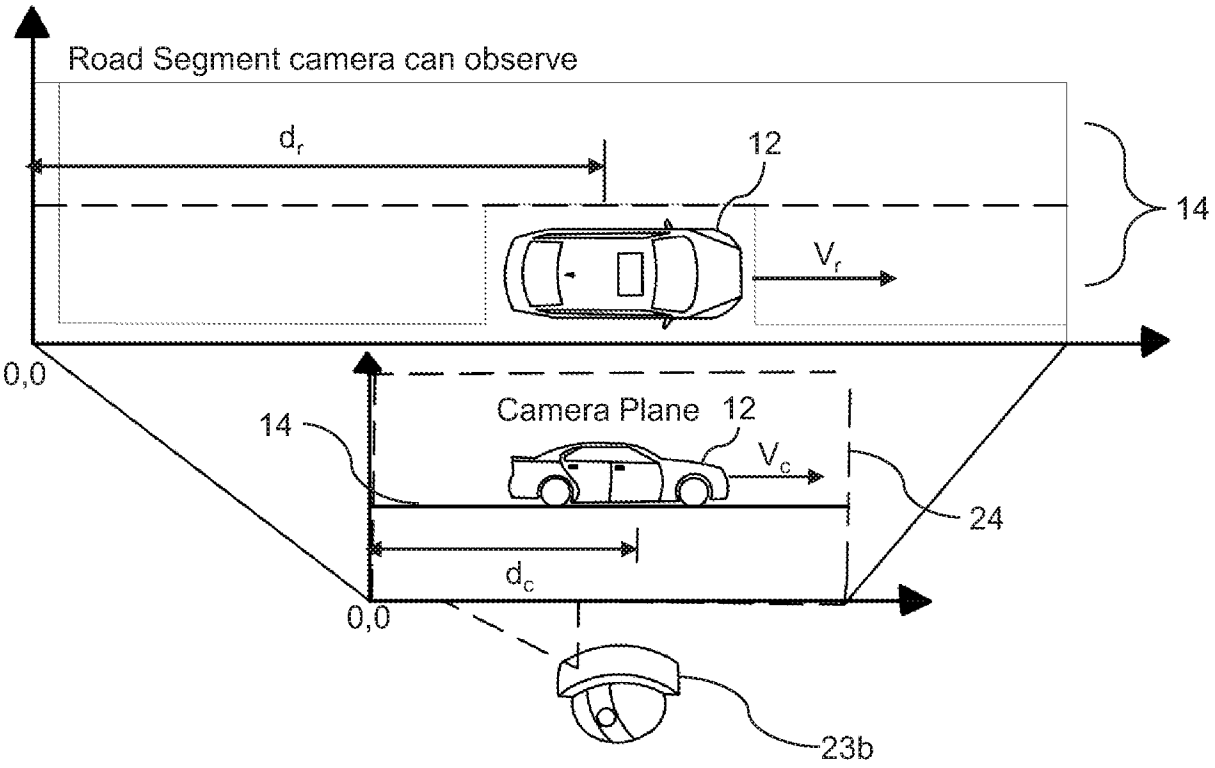
FIG. 3 is a schematic showing that one dimensional real-world motion translates to one dimensional motion in a camera plane.
Figure 4:
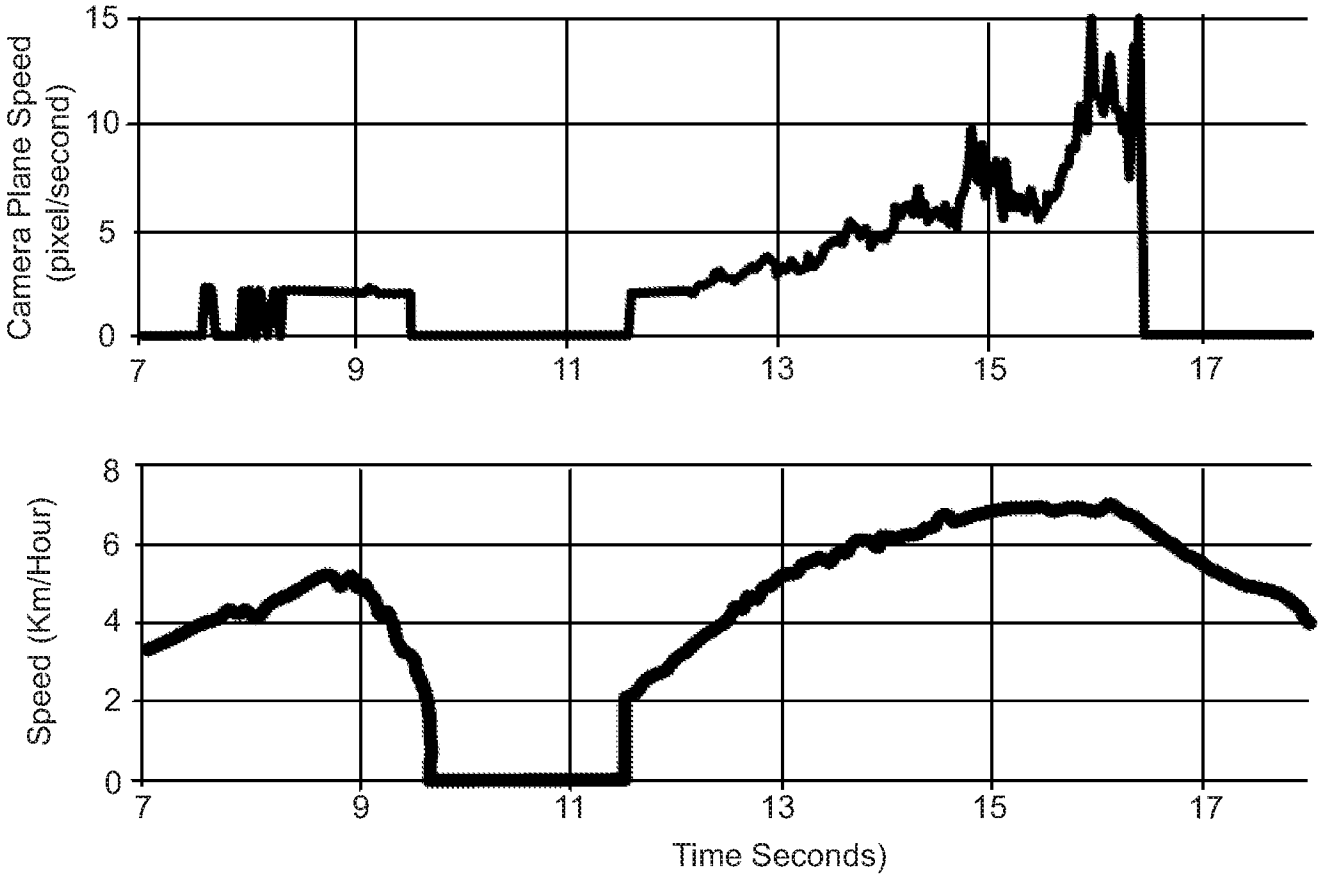
FIG. 4 are graphs that show the optical speed of a vehicle traveling into a lane, which may be used to estimate a stop time and oscillations of vehicular motion.

FIG. 3 is a schematic showing that one dimensional real-world motion translates to one dimensional motion in a camera plane 24. FIG. 4 are graphs that show the optical speed of a vehicle 12 traveling into a lane 14, which may be used to estimate a stop time and oscillations of vehicular motion. In FIG. 4, the camera plane speed of vehicle 12 coming into the lane 14 is plotted from low speed indoor experiments. The plotted values can provide a start time, a stop time, etc. but cannot provide the exact speed of the vehicle 12.

Camera-generated motion signatures. Since the camera 23*b* does not measure the depth of objects in its field of view, camera-based techniques have to find a way to convert from the rate at which objects move in the camera plane 24 (which may be called the optical-speed), and measured in pixels per second, to the actual velocity of the object being observed. Related art on measuring speed using cameras falls into two categories. First, speed estimation has been done through utilizing known anchor points in the camera's locus of measurement. For example, related art in image processing to calculate speed has been based on when vehicles cross prepositioned lane markers. Other related art in speed estimation techniques use carefully (and manually) calibrated formulas based on the camera position and angle as well as known locations of anchor points in the cameras field of view, to convert from pixels to meters per second.

The above approaches lack workability and advantages mainly because of complicated manual alignment of the camera, or complex training and calibration of the algorithms were to be avoided in the methods and systems of the present embodiments. In addition, since some embodiments use a camera that has to be placed in somewhat close proximity to the vehicle, the algorithms need to be robust enough to deal with extraneous movements generated by objects that are near or on the moving object, such as hand movements by the driver.

In some embodiments, Soft Swipe 10 filters out extraneous motion by spatially filtering out any pixel translation that is not in the direction of the moving car 12. Next, Soft-Swipe 10 auto-calibrates the speed measurements generated by the camera 23*b* by matching the internal and camera-generated motion signatures. The auto-calibration then works as follows. After the camera 23*b* is placed, a single test run is made by the vehicle 12. Next, Soft-Swipe 10 collects the pixel-based location-directed, external motion signature from the camera. Soft Swipe 10 then collects the object-tagged motion signature from the device inside the car 12. Soft-Swipe 10 then heuristically aligns the two motion signatures by time. The heuristics include aligning by stop-and-start periods, or periods with significant accelerations and decelerations. While these can be basic heuristics, the heuristics were used in these test runs were virtually error-free. By comparing the two motion signatures, Soft-Swipe 10 builds a mapping function that translates from pixels/second to meters/second across the path of the moving object. Essentially, the mapping function is a location-dependent scaling multiplier that converts from optical speed to actual speed.

In the embodiments, Soft-Swipe 10 models the movement of vehicles into a one-dimensional model, and observes or otherwise looks out for, the lane dimension information to design a spatial filter. The linear movement of the vehicle corresponds to a straight line motion in the camera plane 24, as shown in FIG. 4. As the vehicle 12 enters the station, the vision system 22*b* traces the vehicle's line of motion and the dimensions of the vehicle 12 in the frame. This directional information is used to create a spatial filter across the lane 14 in the vehicle's motion direction. Any motion observed outside the spatial filter (outside lanes) or in a different direction is filtered.

Some embodiments involve stop-time estimation. For example, the filtered vehicle's motion provides the vehicle position and speed observed in the camera frame, which can be used to obtain a stop time. The speed observed in the camera plane 24 is referred to as optical speed herein. FIG. 4 presents the average optical speed of a vehicle 12 plotted against time. As shown in FIG. 4, this plot is used to determine the state of the vehicle 12 in time with an accuracy of frame-rate (0.02 sec. for 50 fps). In dense scenarios, the vehicles 12 might stop in the same time stamp (within 0.02 sec.). Therefore, speed of the vehicle 12 with time is needed to enhance additional distinguishability between vehicles.

Some embodiments involve motion profile by tracing the line. For example, the vehicle speed can be obtained by training the system 10 for a scaling factor, wherein $l_v$ and $l_r$ are the lines representing the line of motion in the visual plane and the real world, and $V_r(d_c)$ denotes the real velocity of a vehicle at distance $d_r$ in the real world, and $d_c$ in the camera plane 24, and $V_c(d_c)$ is the velocity observed in the camera-plane 24. If the scaling factor $$\gamma(d_c) = \frac{\Delta d_r}{\Delta d_c}$$

is known then, real velocity can be estimated by $V_r(d_c)=\gamma(d_c)V_c(d_c)$. The value of $\gamma(d_c)$ is usually obtained from the training.

Some embodiments involve self training. Soft-Swipe 10 can use the data from inertial sensors on the phone to train the vision system 22*b* by obtaining the scaling factor $\gamma(d_c)$. Distinguishability is only needed when there are many vehicles, but in situations where there is a single vehicle, then it is evident that the vehicle 12 observed in the frame is the vehicle 12 transmitting the motion profile. The single vehicle scenarios are used to estimate scaling factor $$\gamma(d_c)_e = \frac{V_r d_c}{V_c d_c}.$$

Some embodiments involve noise filtering. For example, the human movements inside the vehicle 12 are visible to the camera 23*b* from the windshield. These random human movements are filtered in order to accurately estimate speed. Also, human movement on the lanes 14 is very often in an indoor environment, and these movements need to be filtered to reduce or avoid false alarms and matching errors. Soft-Swipe 10 employs directional filtering and filters any motion other than in the direction of $l_c$. This $l_c$ direction is obtained as a part of a self-training algorithm.

Motion-profile extraction can be provided by widely deployed cameras via a software based approach. This method does not require significant, or in some cases any, training by users, and this system 10 is easily movable from one place to another. This system 10 is also robust to noise and random movements in the environment, and calibrates the motion profile of the vehicle 12.

B. Sensor Fence: Motion by Passing

This section presents a motion profile estimation of vehicles by using external sensors. In the embodiments, the motion estimation of vehicles can be broadly classified into the following three categories: motion estimation from Doppler shift by using LIDAR, RADAR and microwave technologies (ex: RADAR speed gun); the metallic body of the vehicle 12 is detected by deploying inductive coil in the road; and vision based techniques that are addressed above.

In the related art, these approaches are designed to measure the high speed of vehicles. However, enabling vehicular NFC requires the detection of low speeds in the order of a few miles/hour. It may not be beneficial to pursue the above approaches for at least the following reasons, i.e., interference, hidden vehicles, and low speeds to sense.

With regard to interference, the system must work in the context of dense deployment. In crowded scenarios, Doppler shift is caused by all the vehicles 12 in the neighborhood, and cannot be used to derive speed. In the context of indoor environments, random human movements on the lanes 14 is common, which might contribute to Doppler shifts.

With regard to hidden vehicles, if a speed-gun is aimed at one vehicle, then the speed-profile of the next vehicle is lost. Inductive coils fail to distinguish the next vehicle because they can only detect the metallic nature of vehicles.

With regard to low speeds to sense, Doppler shifts caused by the low speeds is small and needs high procession hardware to detect the resultant small Doppler shifts.

Figure 5:
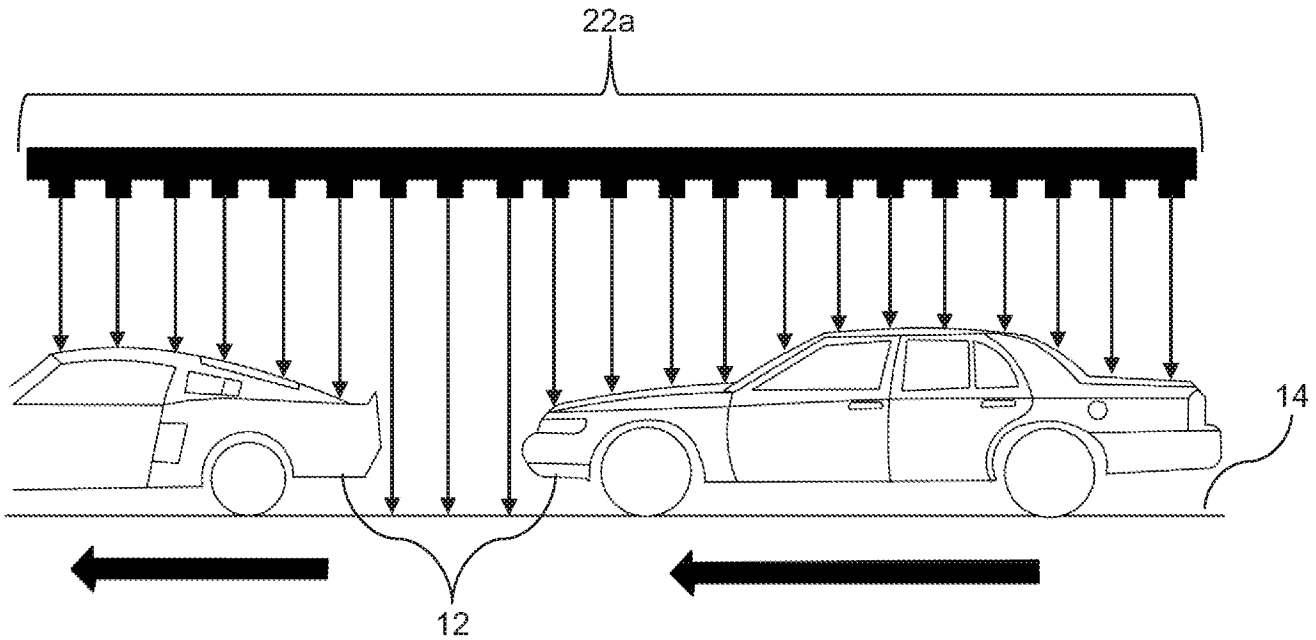
FIG. 5 is a schematic of a sensor fence that can be used to capture the shape and speed of a vehicle.

FIG. 5 is a schematic of a sensor fence that can be used to capture the shape and speed of a vehicle 12. In the context of an exemplary sensor array design, it may be beneficial to address the above challenges by designing an array of sensors 22*a*, hung from the ceiling and parallel to the ground, as shown in the FIG. 5. Each lane can be equipped with a sensor array 22*a*, which can cover the entire vehicular service station. Inexpensive ultra-sonic range sensors, which are typically used as robot-eyes, can be used in the sensor array 22*a*. The sensor array 22*a* continuously measures the depth to distinguish the ground and vehicle 12 and estimates the shape of vehicle 12.

With regard to being interference resistant, the shape information not only makes clear the distinction between interfering vehicles (close vehicles), but also eliminates random human movements, thereby making the system 10 more robust. Doppler based designs cannot provide this level of robustness because they merely measure movement in the environment. The sensor array 22*a* can measure motion of multiple vehicles at a time, whereas employing a speed gun based approach requires the user to position the speed gun at a certain angle to measure the single vehicle's motion.

Because the sensor array 22*a* is located above the vehicle 12, such as being hung from the ceiling, and senses along the entire length of the station, there are no hidden vehicles. Solely based on depth information, Soft-Swipe 10 intelligently estimates speed of the vehicle 12 at a high rate, and outputs the shape as a byproduct. This shape information can be used by toll systems to selectively charge the toll. Once matching is performed, this shape information can also be used to verify the vehicle's identity.

With regard to low speed sensing, as the vehicle 12 enters the lane 14, it triggers each sensor i at a unique time stamp $t_i$, wherein $t_i$, $t_{i+1}$ represents the timestamps the vehicle 12 triggers the sensors i and i+1 and D be the distance between these two sensors. The average speed during this time can be given as $$\frac{D}{t_{i+1}-t_i}.$$

This approach can be termed trigger-speed, because it estimates speed based on sensor trigger time. Because this approach only measures the time taken to cover a given distance, it can measure low speeds, which is not possible (or difficult) using other approaches. This method generates K−1 velocity samples in a K sensor array system. As shown in FIG. 1, the speed of vehicles changes at a high rate, and obtained K−1 samples cannot capture the complete motion profile of the vehicle 12.

Figure 6:
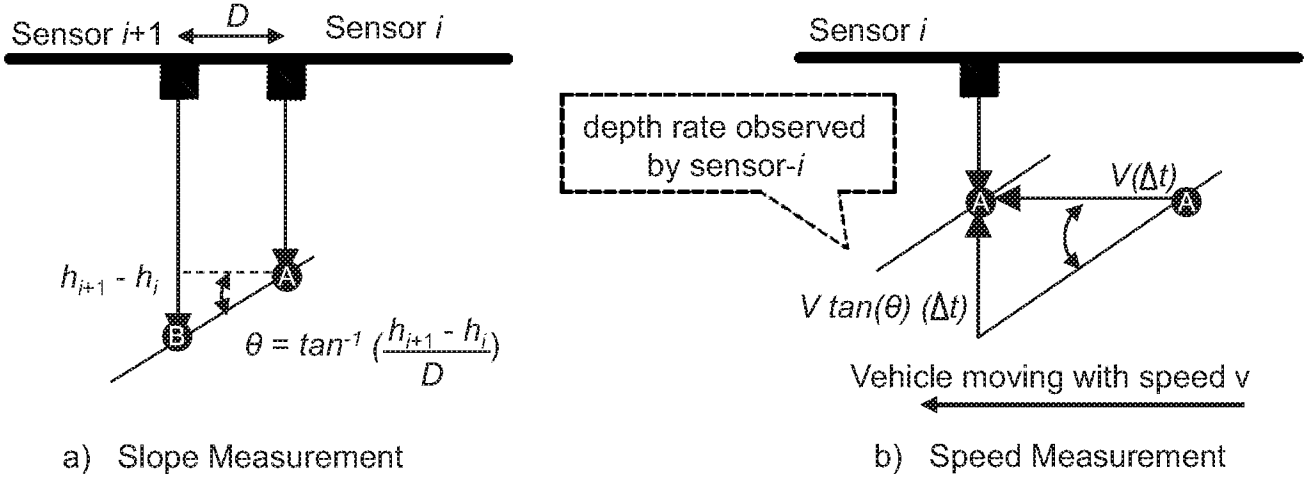
FIG. 6 is a schematic that shows that two points on vehicle A, B that are close to each other can be used to measure the velocity component of the vehicle in the sensor direction.

FIG. 6 is a schematic that shows that illustrates the speed calibration from sensors on a vehicle 12. Sensors that are close to each other are placed at two points A, B on the vehicle 12 and can be used to measure the velocity component of the vehicle 12 in the sensor direction.

Some embodiments involve enhancing the sample rate. For example, the rate of change of depth measured from sensors is proportional to the speed of vehicle, which can be used to measure speed from high-rate depth information. The vehicle's body can be modeled by a set of planes $\{P_1, P_2, P_3, \ldots P_n\}$ and a corresponding set of slopes $\{m_1, m_2, m_3, \ldots m_n\}$, such that i, i+1 constitute consecutive sensors that point to the same plane $P_j$ and meet the plane at points A and B, as shown in FIG. 6. The depths observed by these sensors are $h_i$ and $h_{i+1}$ respectively. Then, the slope of the plane $P_j$ is given $$m_j = \left(\frac{h_{i+1}-h_i}{D}\right).$$

Because of the sensor's noise n(variance σ), the depth estimation will be $h_i = h_{ir} + n$, where $h_{ir}$ is the real depth and $h_i$ is the measured value. As the vehicle 12 moves with velocity V, the depth of sensor i changes with rate $V*m_j$ as shown in the FIG. 6. Therefore, the speed of the vehicle 12 can be estimated as a function of sensor's depths, as provided by $$V_e = \frac{\Delta(h_{ir})+2n}{\Delta t} * \frac{D}{h_{(i+1)r}-h_{ir}+2n}$$

where $V_e$ is the estimated speed, Δt the sampling interval of sensor and $\Delta h_{ir}$ the height difference during this sample interval. This approach can be referred to as sensor fence, because it uses the fence property to measure the speed of vehicles.

Sensor-fence provides the speed of a vehicle 12 at a very high sample rate, and is used to measure low dynamic speeds. However, if the speeds are very high and not very dynamic (which may occur in toll based applications), then using sensor-fence is very expensive and inefficient in such cases, and the Soft-Swipe 10 uses trigger-speed to measure the speed. In order to estimate the speed from the above equation, the following design parameters must be selected properly.

(i) Sensor selection: As the vehicle 12 moves across the sensors i and j meets vehicle at points A and B. If these points are on different planes, then the above Equation will not hold. If two points are on same plane, then their rate of depth change must be the same $$\left(\frac{\Delta h_i}{\Delta t} = \frac{\Delta h_{i+1}}{\Delta t}\right),$$

and it these rates are not same, then sensor reading pair i and j must be disregarded.

(ii) Number of sensors: If the speed of the vehicle 12 is high, then the vehicle 12 will trigger multiple sensors in a single sample interval. Soft-Swipe 10 disregards sensors between sensors j and i only if $t_j - t_i >> \Delta t$. Therefore, a long sensor array is needed to estimate a wide range of speeds. The speed limit $V_l$ and number of sensors K must be selected such that $$K \gg \frac{V_l \Delta t}{D}.$$

(iii) Sensor density: As the sensor density increases, the inter-sensor distance decreases. Very close sensors are able to perceive the same distance on an inclined plane due to measurement noise. Based on the speed estimation Equation above, the distance between sensors D, which is in order of $h_{i+1} - h_i$, must be chosen in such a way that $D >> 2\sigma$.

(iv) Sampling time: If the sampling rate is very high, then the depth difference observed in a sample time will be small and affected by the noise floor. The sampling time Δt is chosen to be high by discarding samples or reducing the sample rate, such that $\Delta(h_1) >> 2\sigma$.

(v) Dropping data: Some of the velocity samples estimated are prone to noise due to the shape of the vehicle 12. If the depth difference is $h_{i+1} - h_i >> 2\sigma$, then $V_e$ estimated must be considered.

Some embodiments involve the shape as a byproduct. By the end of the above algorithm, all the slopes $\{m_1, m_2, m_3, \ldots m_n\}$ are estimated. Measuring the length of the plane can be performed by using the current velocity and the time of stay on a particular plane. This provides the length of the planes $\{l_i, l_2, l_3, \ldots l_n\}$ of the vehicle (e.g., windshield length). This information can be used by a toll system to classify the vehicle as a car, truck, etc., and selectively charge the vehicle based on the vehicle type.

Some embodiments involve a sensor-array approach for capturing the motion profile. This system approach is inexpensive and easy to deploy, and can work even in a dense environment with a wide range of speeds. A non-uniform sampling rate and sensor density might result in a more accurate estimation of motion profile in some scenarios.

C. Adaptive Vision and Sensing

In some embodiments, the sensor system 22*a* and vision system 22*b* can work independently to sense the motion signatures. However, some eternal factors, such as light condition, misplacement of the sensor array and camera, etc., may affect the performance of the individual systems.

It can be beneficial to analyze the properties of motion profile estimation using the sensor-array 22*a* and vision systems 22*b*. In some embodiments, an adaptive weight based approach is used to combine these profiles to create an accurate motion profile. Initially, both the sensor-array 22*a* and vision systems 22*b* are analyzed individually to model parameter that enhance or optimize the performance. Based on these parameters, the embodiments combine the observation from two systems and use a Minimum Mean Square Error (MMSE) estimation to estimate the speed of vehicles. In the related art, this approach requires calibration and modeling of vision and sensor systems. In the present embodiments, machine learning methods based on MMSE can combine the sensor-data efficiently without the calibration and modeling of the relate art methods.

The experimental data used to analyze the methods and system of the embodiments depicts that the vision system performance varies according to a number of parameters described below.

Figure 7:
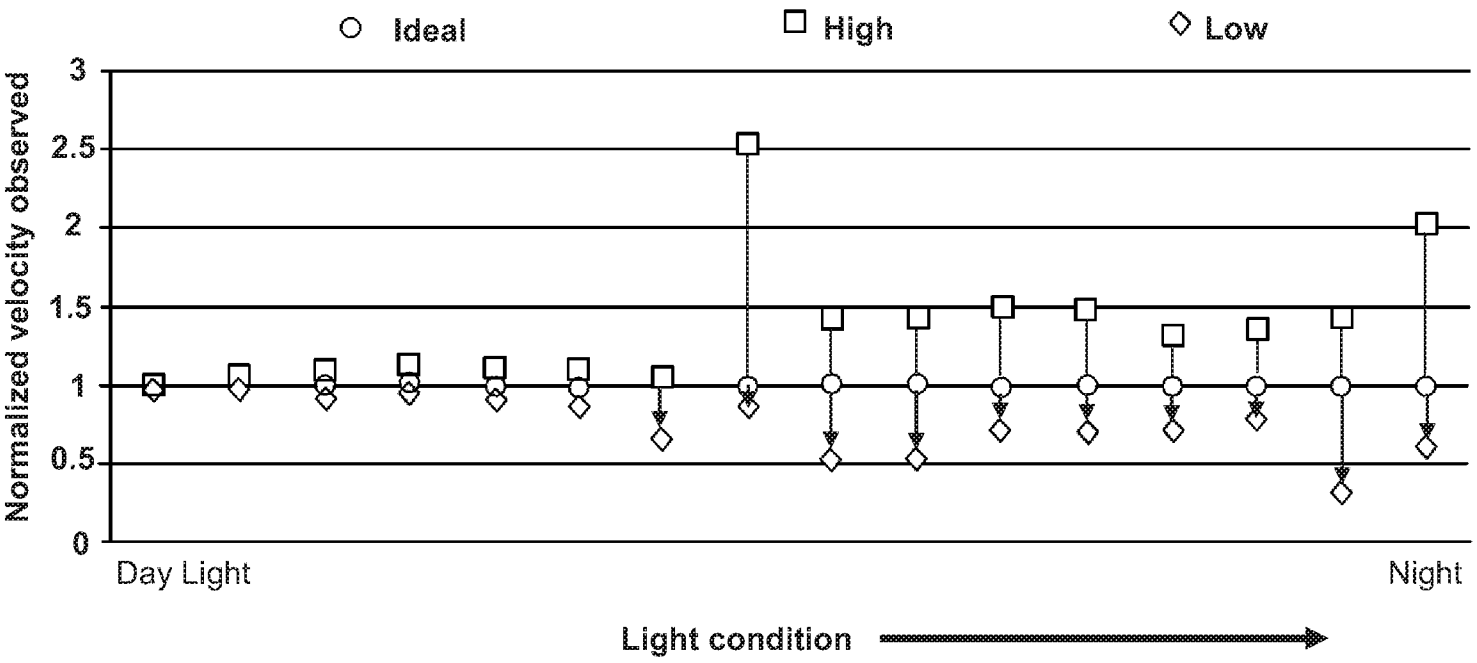
FIG. 7 is a graph showing velocity estimation accuracy under different light conditions.

Some embodiments include a first parameter that includes the light condition. With a reduction in light intensity, the movement detection accuracy between consecutive frames decreases due to high number of dark pixels in the frame. FIG. 7 is a variance graph that shows velocity estimation accuracy under different light conditions. These different light conditions are created by applying pixel-transform and studied for speed and estimation accuracy.

Distance from camera: As the distance between the vehicle 12 and the camera 23*b* increases, its observability in the frame decreases and eventually devolves into ambient noise beyond some point. Vehicle 12 at a distance from camera 23*b* corresponds to set of pixel points averaged to unique point on a frame. Hence, the speed measurement accuracy decreases with increase in measurement distance.

Figure 8:
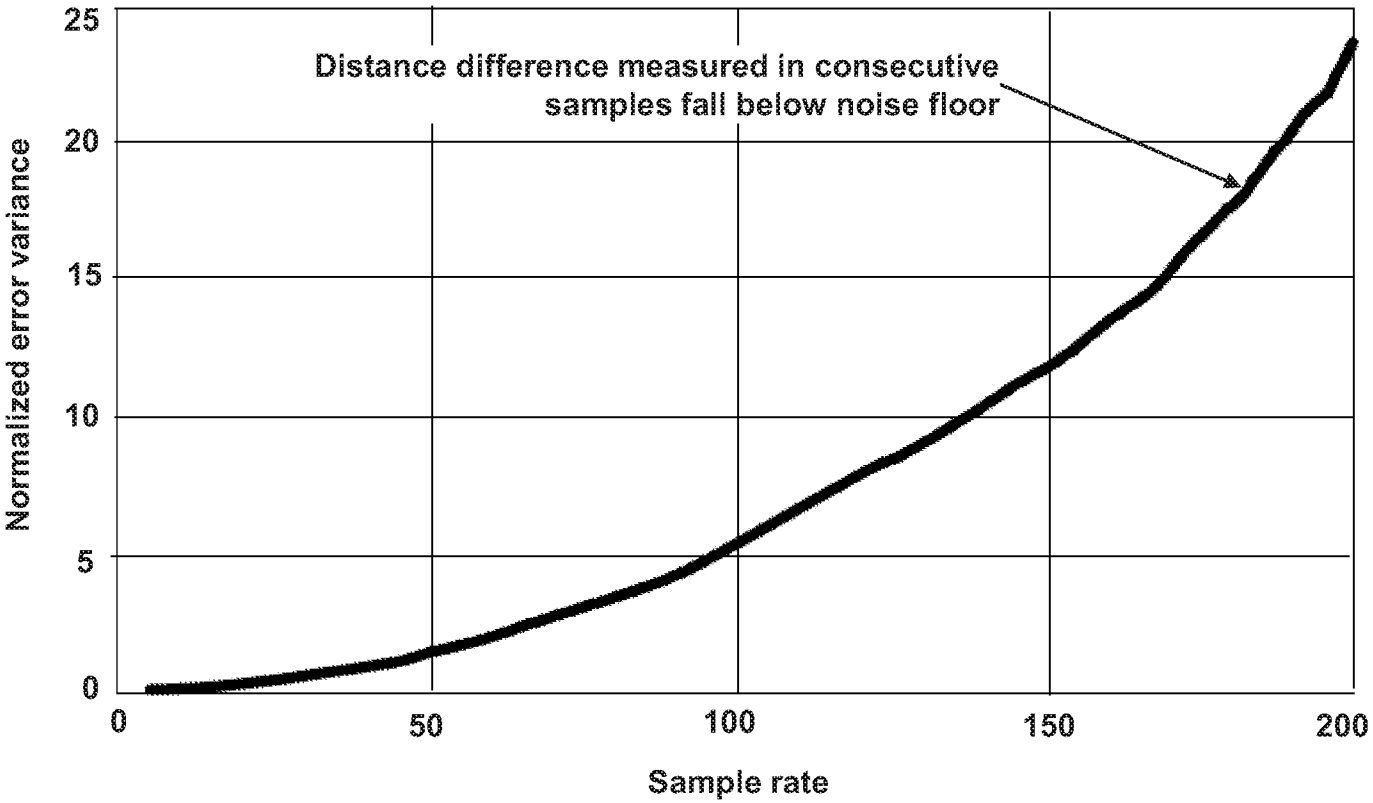
FIG. 8 is a graph showing velocity estimation accuracy for different sample rates of a vehicle's velocity.

In some embodiments, the sensor-array motion profiling performance can depend on, but is not limited to, the following parameters. Sample rate: The vehicle's velocity is measured by using the rate of change of depth from the ceiling at an enhanced or maximum sample-rate of, for example, 20 samples/second. FIG. 8 plots the accuracy of velocity estimate for different sample rates. With low inter-sample time (i.e., high sample rate) the height difference observed in consecutive time slots is affected by noise leading to inaccurate measurement of speed. But reducing the sample-rate cannot capture the complete motion profile, as shown in FIG. 8. To use high sample-rate without reducing the speed estimation accuracy, more accurate depth sensors can be selected.

Figure 9:
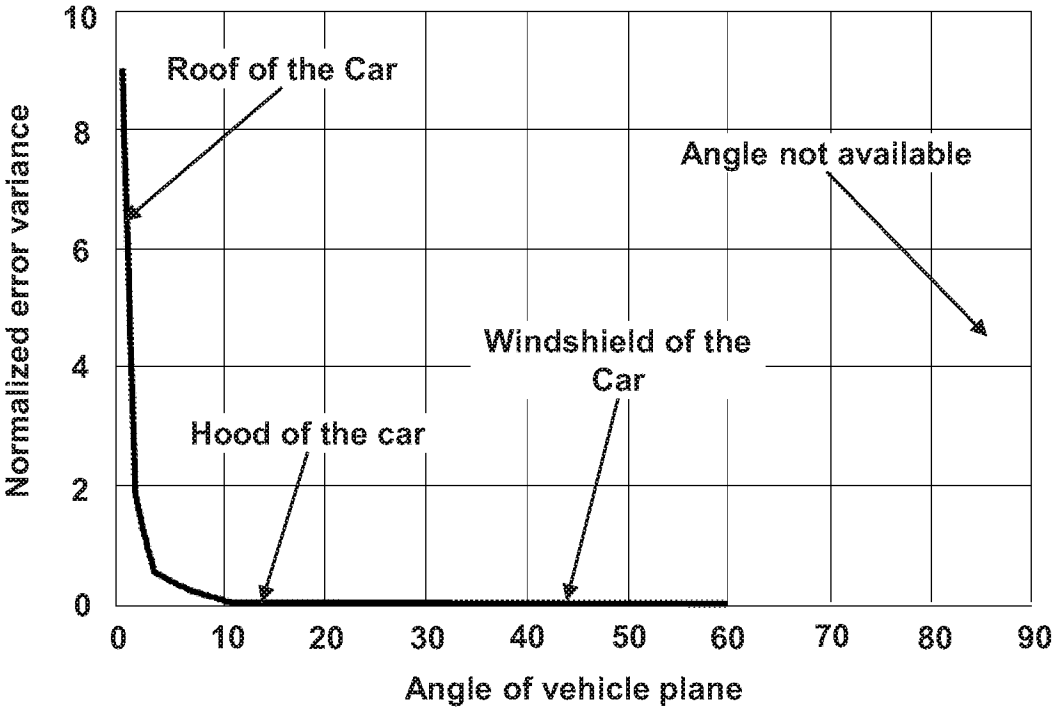
FIG. 9 is a graph showing the velocity estimation accuracy for planes observed from a vehicle.

Performance can further depend on angle of measurement (θ): Soft-Swipe 10 estimates the velocity by measuring the slope of a vehicle 12. Let θ be the angle of this plane in subsequent sections of paper. FIG. 9 shows the velocity estimation accuracy for planes observed from a vehicle 12. The slope of these planes are measured by observing depth difference between consecutive sensors which will be affected by the noise floor. Therefore, the slope measurement is not accurate for smaller angles causing inaccurate measurements of velocity. Notably, accuracy increases with the angle, but the chance of having higher angle planes on vehicle with horizontal spread of inter-sensor distance (30 cm in the design of the embodiment) is low. The best angular plane observed by the sensor array is the windshield.

Some embodiments can include compensation through collaboration. In view of the above disclosure, the sensor-array 22*a* and vision system 22*b* accuracies depend on parameters independent of each other. Further, these parameters need to be calibrated and studied for accuracy of measurement before using the system 10. In the embodiments, these two observations can be used to design a combining scheme, where one system corrects the erroneous measurements from the other. For example, the vision performance depends on the distance from camera 23*b* whereas the sensor-array 22*a* performance remains constant along the lane 14. In such cases, the sensor-array 22*a* can be used to improve the vision system performance. Similarly, when a flat vehicle such as a bus enters a lane 14, the sensor performance drops due to lack of an inclined plane. In such cases, vision helps to restore performance.

The collaboration between the camera 23*b* and sensor-array 22*a* deployed in each lane 14 is enabled by fusing their independent velocity measurements adaptively. Let the velocity measured by camera 23*b* and sensor array 22*a* be $\hat{v}_c(t)$ and $\hat{v}_s(t)$ respectively at time t in a given lane 14, then the velocity estimated due by combining, $\check{v}(t)$ will be $$\check{v}(t)=w_c(t)\hat{v}_c(t)+w_s(t)\hat{v}_s(t) \tag{1}$$

where $w_c(t)$ and $w_s(t)$ are the weights of camera and sensor array measurements, respectively, quantifying the confidence or accuracy of individual measurements.

Fair estimate of weights can be obtained by studying statical properties of velocity estimates. The camera and sensor measurements can be modeled as $\hat{v}_c(t)=v_r(t)+e_c(t)$ and $\hat{v}_r(t)=v_r(t)+e_s(t)$ where $v_r(t)$ is the real velocity of the vehicle and $e_c(t)$, $e_s(t)$ are measurement errors of the camera and the sensor, respectively. These errors are pure-random and cannot be corrected. Therefore, $E(e_c(t))=E(e_s(t))=0$ and variance $(e_c(t))=\sigma^2_c(t)$ and variance $(e_c(t))=\sigma^2_s(t)$. Also the weights must be normalized: $w_s(t)=1-w_c(t)$. Therefore the error in combining is $e=w_c(t)e_c(t)+w_s(t)e_s(t)$. Minimum mean square error (MMSE) estimation of velocity reduces to reducing or minimizing error variance $\sigma^2_e$ as shown below:

$$E(e^2(t))=\sigma_e^2(t)=w_c(t)^2\sigma_c^2(t)+(1-w_c(t))^2\sigma_s^2(t) \tag{2}$$

This mean square error is minimized for $$w_c(t)=\frac{\sigma_s^2(t)}{\sigma_s^2(t)+\sigma_c^2(t)} \tag{3}$$

In order to estimate $w_c(t)$, error variances of camera observation $\sigma^2_c(t)$ and sensor observation $\sigma^2_s(t)$ must be calibrated. This involves modeling the sensor array 22*a* and vision systems 22*b* and manual calibration for system parameters such as height of camera placement, angle of camera tilt etc. Large sample sets are needed to estimate them accurately. Since modeling the system 10 and observing large sample sets require considerable effort and manual intervention, the embodiments instead automate the system 10 using a simple yet intelligent machine learning technique as described below.

Figure 10:
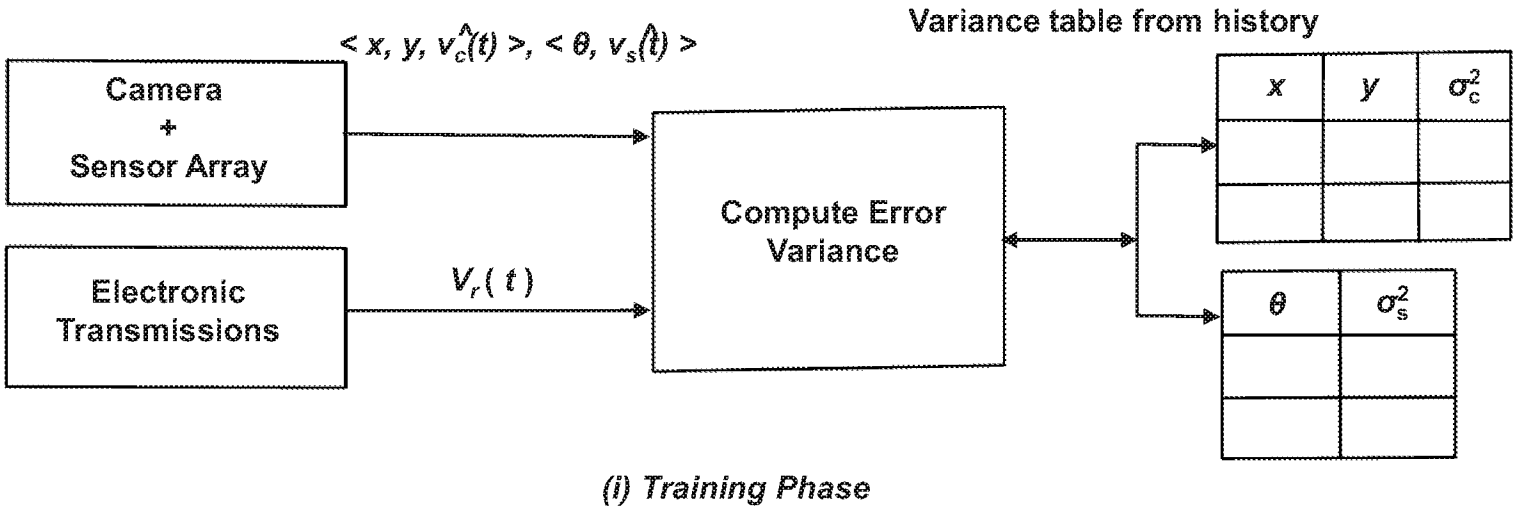
FIG. 10 is a functional flowchart showing data-flow while estimating weights for MMSE estimation from a history table.

Some embodiments include machine learning based MMSE Estimation. In the embodiments, the learning and estimation can be performed in the following steps: (i) Constructing the training set: The training set is created and updated in two phases. First during the training phase, for each lane 14, the user performs trial runs to create different possible (<x,y>,θ) pairs and measures $\hat{v}_c(t)$ and $\hat{v}_s(t)$. Along with the estimated velocities the training set contains associated real velocity $v_r$, which is obtained from the vehicle's electronic messages. Second during the test phase, if there is only one vehicle 12 in the vehicle-station, then the electronic transmissions of corresponding vehicle 12 is used to train the system deployed in its lane 14. During this test phase, both vehicle transmissions and sensor observations are added to this set providing large training set whose size increases with time. FIG. 10 is a functional flowchart showing data-flow while estimating weights for MMSE estimation from a history table.

FIG. 10 presents these two phases and represents the table construction. (ii) Computing the variance table: With this continuous training set, the sample variances $\sigma^2_c(t)$, $\sigma^2_s(t)$ are incrementally estimated and an association table is created for parameters (<x, y>$\sigma^2_c(t)$), (θ, $\sigma^2_c(t)$). Further, a smoothing function can be applied on this table to average close observations creating continuous trend of variance.

Figure 11:
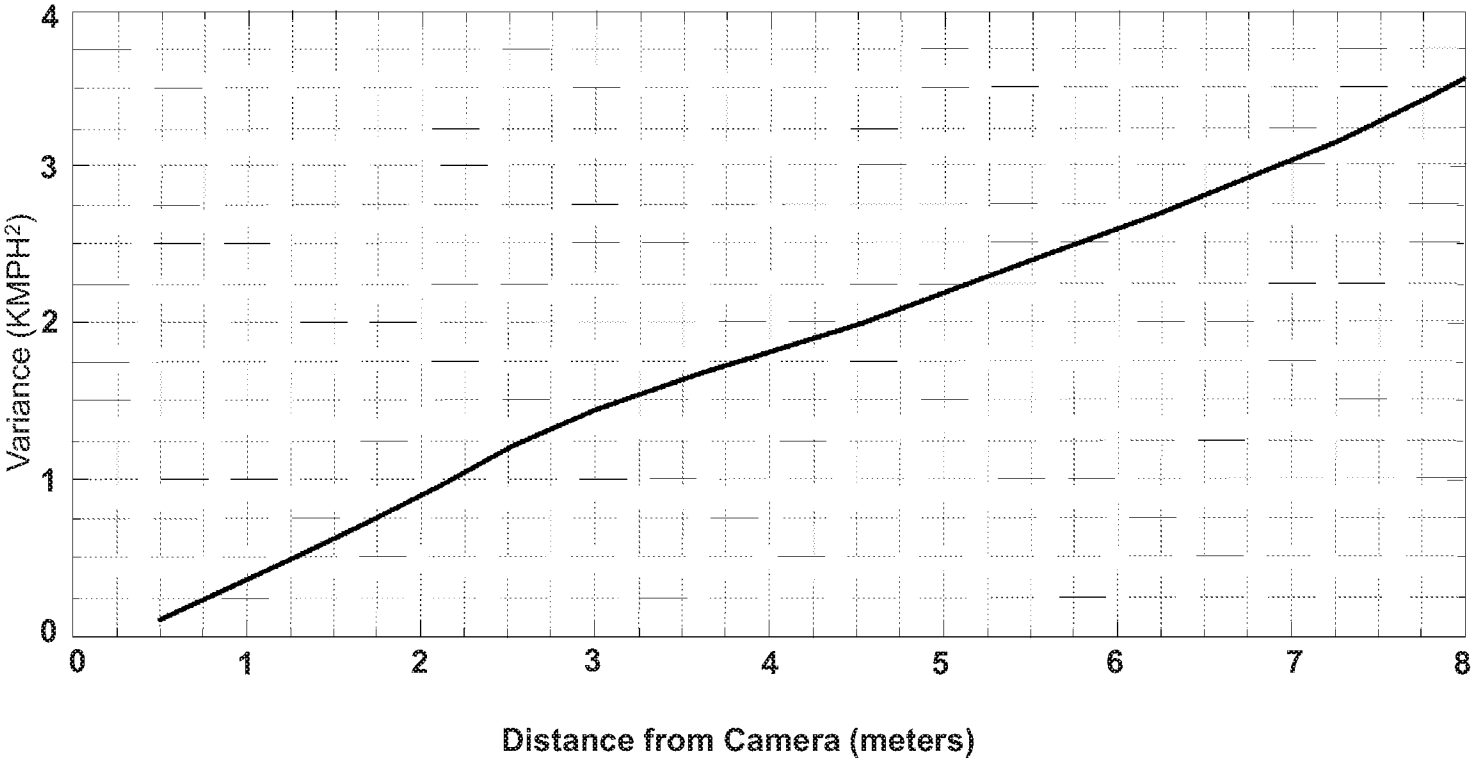
FIG. 11 is a graph showing results camera speed estimation error variance plotted with vehicle-position from camera frame for multiple experiments.

FIG. 11 is a graph showing results camera speed estimation error variance plotted with vehicle-position from camera frame for multiple experiments. FIG. 11 presents $\sigma^2_c(t)$ plotted as function of distance from camera 23*b* from history table for twenty experiments. This distance from camera 23*b* is mapped to pixel-position using a fixed transformation function.

(iii) Estimating the velocity: Often vehicles traveling in the same lane with similar build (e.g., car, truck, etc.) have repetitive (x, y, θ) values. As a result of this for repeating (x, y, θ), the variances can be looked up from the table. From the variance obtained from table look-up, the weight $\hat{w}_c(t)$ is estimated using Equation 3 which gives the velocity as $$\hat{v}(t)=\hat{w}_c(t)\hat{v}(t)+(1-\hat{w}_c(t))\hat{v}_s(t) \tag{4}$$

The velocity estimated $\hat{v}$ at each time t has different measurement errors which must be considered when computing the motion profile of a vehicle 12 over a time-interval. This measurement error is quantified by the variance of measurement $\hat{\sigma}^2(t)$ which is derived using camera measurement error variance $\hat{\sigma}_c^2(t)$ and sensor measurement error variance $\hat{\sigma}_s^2(t)$ obtained from table lookup using Equation 3 and 2 as $$\hat{\sigma}^2(t) = \frac{\hat{\sigma}_c^2(t)\hat{\sigma}_s^2(t)}{\hat{\sigma}_s^2(t) + \hat{\sigma}_c^2(t)} \tag{5}$$

In the embodiments, the collaboration mechanism is described for only vision system 22*b* and sensor array 22*a*. However, other embodiments intend to include, or otherwise cover other systems with vision systems 22*b* and sensor arrays 22*a*, including any number of sensors observing the motion profile.

D. Asynchronous Matching Algorithm

Some embodiments involve a matching algorithm that takes motion signatures observed in different lanes 14 and different vehicles 12, and maps vehicles 12 to corresponding lanes 14. Different vehicles transmit their motion profile, and the sensor system 22*a* in the lanes 14 transmits the sensory data to a central server, where it is processed to perform matching. However, Soft-Swipe 10 evaluates this architecture and can include a two-step matching algorithm 30 that is disclosed below.

Related art time-series matching techniques can be classified into the following two categories: distance similarity and feature similarity. Distance similarity schemes measure the similarity by comparing the distance between two time series. Dynamic time warping (DTW) and edit distance are examples of these algorithms. Feature similarity schemes extract the features from the time series and compare the features to obtain similarity.

Employing the above techniques may result in the following implementation problems that include but are not limited to: delay, data rate, and packet loss. Thus, it may be beneficial to employ a distributed 2-step matching. As the vehicle 12 enters into the lane 14, the clustering algorithm takes electronic transmissions E and lane observations O and sensor stream S. The two step matching may constitute the most suitable architecture for matching based at least on the motion model, quick matching, and packet loss.

With regard to the motion model, the motion of the vehicle 12 can be modeled by user actions, such acceleration, deceleration, etc. All of these actions can provide a distinct signature, which can act as a first step of filtering. With regard to quick matching, clustering the vehicles 12 based on their motion signatures is easy on both the vehicle 12 and on the central server side. This approach is also susceptible to packet loss.

In some embodiments, essentially matching is performed between two domains (sets of data). (i) Electronic transmissions from m electronic-identities, $E=\{e_1, e_2, e_3 \ldots e_m\}$ (e.g., IP-Addresses or MAC-Addresses of smart-phones) each of them transmitting their motion profile wirelessly. Motion profile from electronic transmissions of $e_i$ is received as a packet stream holding the velocity information $v_i^e(t)$ over a time interval $t\in[T_i^e, T]$. $T_i^e$ is the time $e_i$ electronically visible to AP's deployed in the infrastructure and T is the current time. Further, these electronic motion profiles are assumed to be highly accurate and sampled at high rate. (ii) Observations include motion signatures from l lanes and n observed vehicles $O=\{o_1, o_2, o_3 \ldots o_n\}$. Each observed vehicle $o_j$ sends a data packet stream over a network starting at time $T_i^{oe}$ until the current time T. This packet stream carries motion profile which is output of ($\hat{v}_j^o$ (t), $o_j^2$ (t)) are velocity and error variance of observation at time $t\in[T_j^o,T]$ respectively.

In some embodiments, three critical challenges arise in accurate matching. First, the vehicles 12 are arriving at different times (i. Asynchrony), which lead to motion signatures in observation domain of different lengths. Even with same number of samples in a motion profile, measurement accuracy across different times is not the same (ii. Different accuracies of measurements). Due to the different accuracies of measurements, the noisy observations at one time instant can make accurate observations at other times useless and contributing more randomness to matching. Also, there is no guarantee the vehicles 12 are transmitting their motion profiles (iii. Defective (or) tampered equipment). Lack of measurements from a vehicle 12 can cause a chain of errors in matching.

These three challenges make the problem of matching motion signatures distinct from the problems explored in the related art. These motion signatures are just time-series holding velocity information. Traditionally, Euclidean distance and Dynamic time warping (DTW) are methods employed for finding the distance between two time series. However, these methods cannot handle the noise or non-uniformity in the measurement errors. Longest Common Subsequence (LCS) can be used to handle possible noise that may appear in data; however, it ignores the various time-gaps between similar subsequences, which leads to inaccuracies. Considering this, the embodiments can include an efficient data-selection and weighted scheme which is a modification of Euclidean distance approach and can manage noise and non-uniformity.

Some embodiments include signature selection and weights. First of all, Asynchrony in arrival times of vehicles is considered by filtering out observations below threshold length $T_{th}$. With this filtered data, matching can occur in a time slotted fashion, and all the observations crossing $T_{th}$ in current time slot are matched in the next time-slot. Also, time-slot length $T_s$ and threshold length are chosen such that $T_{th} >> T_s$. This selection makes the matching observations almost equal-length and synchronous. Non-Uniformity in measurement accuracies can be considered by giving weights to the observations based on accuracy. Weights based on accuracy (variance of observation) can be analyzed by considering observation $o_j$ which is spanned in a time window $[T_j^o, T]$ and with $M_j$ samples. The velocity samples represent a point in $M_j$ dimensional space. The mean square error due to measurement noise can be reduced or minimized by weighting observation at time t with weight with $w_j(t)$ over span of $[T_j^o, T]$ as below $$D = E\left(\sum_{t=T_j^o}^{i=T} w_j(t)^2 (\hat{v}_j^o(t) - v_j^o(t))^2\right) = \sum_{t=T_j^o}^{t=T} w_j(t)^2 \sigma_j^2(t)) \tag{6}$$

Additionally, the value D also gives the value of mean square distance shift caused due to measurement error in $M_j$ dimensional space. Also the weights must be normalized over time [0, T] ($\hat{\Sigma}_{t=T_j^o}^{t=T} w_j(t)=1$). The weights are given to reduce or minimize the objective function D which can be formulated as:

$$\underset{w_j(t)}{\text{minimize}} \sum_{t=T_j^o}^{t=T} w_j^2(t)\sigma_j^2(t)$$

$$\text{subject to} \sum_{t=T_j^o}^{t=T} w_j(t) = 1.$$

From Cauchy-Schwarz Inequality, $$\sum_{t=T_j^o}^{t=T} w_j^2(t)\sigma_j^2(t) \sum_{t=T_j^o}^{t=T} \frac{1}{\sigma_j^2(t)} \geq \left(\sum_{t=T_j^o}^{t=T} w_j(t)\right)^2 = 1 \tag{7}$$

Therefore, $$\sum_{t=T_j^o}^{t=T} w_j^2(t)\sigma_j^2(t) \geq \frac{1}{\sum_{t=0}^{t=T} \frac{1}{\sigma_j^2(t)}} \tag{8}$$

The above reduction or minimization function is enhanced or optimized for $w_j(t)\sigma_j^2(t)=K\ \forall t \in [0, T]$ where K is constant. Therefore the weights can be estimated from the variance of each observation as $$w_j(t) = \frac{\frac{1}{\sigma_j^2(t)}}{\sum_{t=T_j^o}^{t=T} \frac{1}{\sigma_j^2(t)}} \tag{9}$$

The computed weights are based on accuracy of measurement as the weight is inversely related to variance of observation. This creates more fair consideration of matching based on accuracies and reduces or minimizes distance between $e_i$ and $o_j$. Further, from Equation 6 for considerably large T, the distribution of D can be approximated as normal-distribution with mean of $$\mu_{Dj} = \frac{1}{\sum_{t=0}^{t=T} \frac{1}{\sigma_j^2(t)}},$$

from Equations 9 and 6 with variance of $$\sigma_{Dj}^2 = \frac{\sum_{t=T_j^o}^{t=T} \sigma_j^2(t)}{\sum_{t=T_j^o}^{t=T} \frac{1}{\sigma_j^2(t)}}.$$

This distribution of D for observation $o_j$ is used to detect corresponding electronic match. Therefore the correct match of $o_j$ is the $e_i$ which produces reduced or minimum D and it must be in the high-confident interval of normal distribution $N(\mu_{Dj}, \sigma_{Dj})$.

Some embodiments include fault detection and matching. From the weights derived from equation 9, for every observation $o_j$ and electronic identity $e_i$ mean square distance D(i, j) is computed and referred as distance matrix in subsequent sections of the paper. In case of different sample rates of $o_j$ and $e_i$ the difference is computed by picking samples from high-sampling domain which are closest in terms of time. Using this distance matrix, the observations, which are very far from the electronic identities, can be identified. These observations that cannot be matched with any electronic identities, signifies the lack of electronic messages from corresponding vehicle. Therefore that particular observation can be tracked, and the corresponding gate can be blocked.

To enable this feature the user defines a parameter c which is the reduced or minimum confidence of the match. This user defined parameter c lies between 0 and 1 and derives the confidence interval of distance D which is normally distributed $N(\mu_{Dj}, \sigma_{Dj})$ for each observation $o_j$. Then for a given $o_j$, if none of $e_i$'s distance falls in this confidence interval, then it is concluded that $o_j$ is far from all $e_i$'s, and if it is not matched for a sufficiently long period, then the transaction has to be performed manually.

If multiple electronic identities fall in the confidence interval derived for given observation ($o_j$), then a greedy approach is performed by matching with the closest electronic identity. Once an $e_i$, $o_j$ pair become matched they are removed from the future matching sets. As described, all the observations which are not matched to electronic identities can be stopped for manual-transaction. Any $e_i$ that is not matched can be carried to the next time slot of matching as these vehicles are yet to enter the vehicular service station. Thus, some of the disclosed embodiments utilize two schemes of enhancing matching.

E. Motion Capturing on Vehicle

IV. Deployment

Described below is an exemplary system deployment according to the disclosure. First, implementation details of the vision sub-system is described. Then the sensor fence deployed in indoor vehicular environment is described, and finally the on-vehicle-deployment and presents various choices for this implementation is described.

A. Vision System Deployment

In the embodiments, an implementation of the vision system 22*b* captures video feed and finds good features in the frame that may be used to track the vehicle. These features typically include corners and boundaries of the vehicle 12, etc. Once these features are extracted, the vision system 22*b* can check how these features have moved across consecutive frames in order to measure the shift of these features. The feature shifts are observed in terms of pixels per unit time and referred as optical flow vectors in the computer vision literature.

Figure 12:
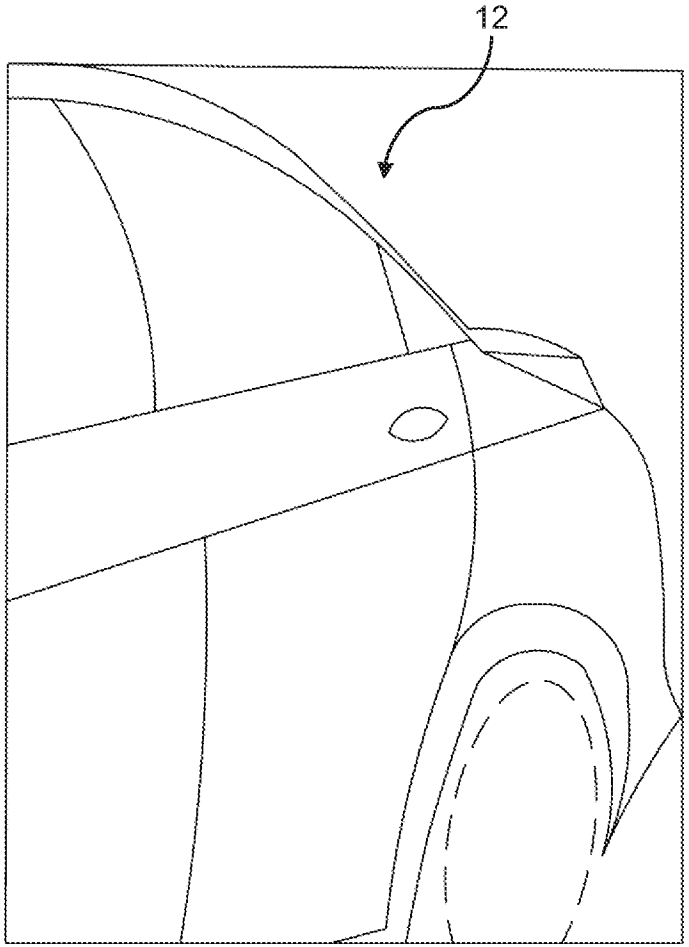
FIG. 12 shows an example of optical flow vectors of a vehicle observed by the vision system.

FIG. 12 shows an example of optical flow vectors of a vehicle 12 observed by the vision system 22*b*. The optical flow vectors from different feature points on the vehicle 12 are aggregated to obtain vehicle velocity in the camera plane 24. A noise-filter can be created to filter out the optical flow vectors that are less than a threshold determined during the initial calibration runs. Small changes in the light-condition and reflections from moving object on the ground create optical flow vectors with much smaller magnitudes compared to optical flow vectors of moving vehicle. Even the vehicle's optical vectors beyond certain distance become small and will be filtered by the noise filter. Therefore vehicles that are far from a camera are not detected by the vision system.

In an exemplary implementation, the vision system 22*b* can be implemented using a commodity wireless USB type camera and mounted 2 meters over the ground level. Additionally, off-the-shelf digital cameras can be used in the implementation. Also, the pixels not corresponding to any lane can be removed by using pixel spatial filter. The camera 23*b* should be mounted at an appropriate height in order to ensure coverage and to approximate vehicle's motion in camera plane to a straight line. In various experiments the camera mount was raised at a height of 2 meters from the ground to achieve coverage and approximate the vehicle's motion to a line. The vision system 22*b* functions on the assumption that the vehicle 12 is a solid object and it does not model or train the system 22*b* to look for specific visual features (such as a shape of the car, a car logo, etc.). Feature based vehicle detection and tracking mechanism (where the vehicle can be classified as car, truck etc.) can be layered on Soft-Swipe 10. Also, the visual-features could be used for matching. However, these visual features cannot distinguish identical vehicles. Soft-Swipe 10, on the other hand, provides accurate matching without depending on vehicle specific properties.

B. Sensor Fence Implementation

Figure 13:
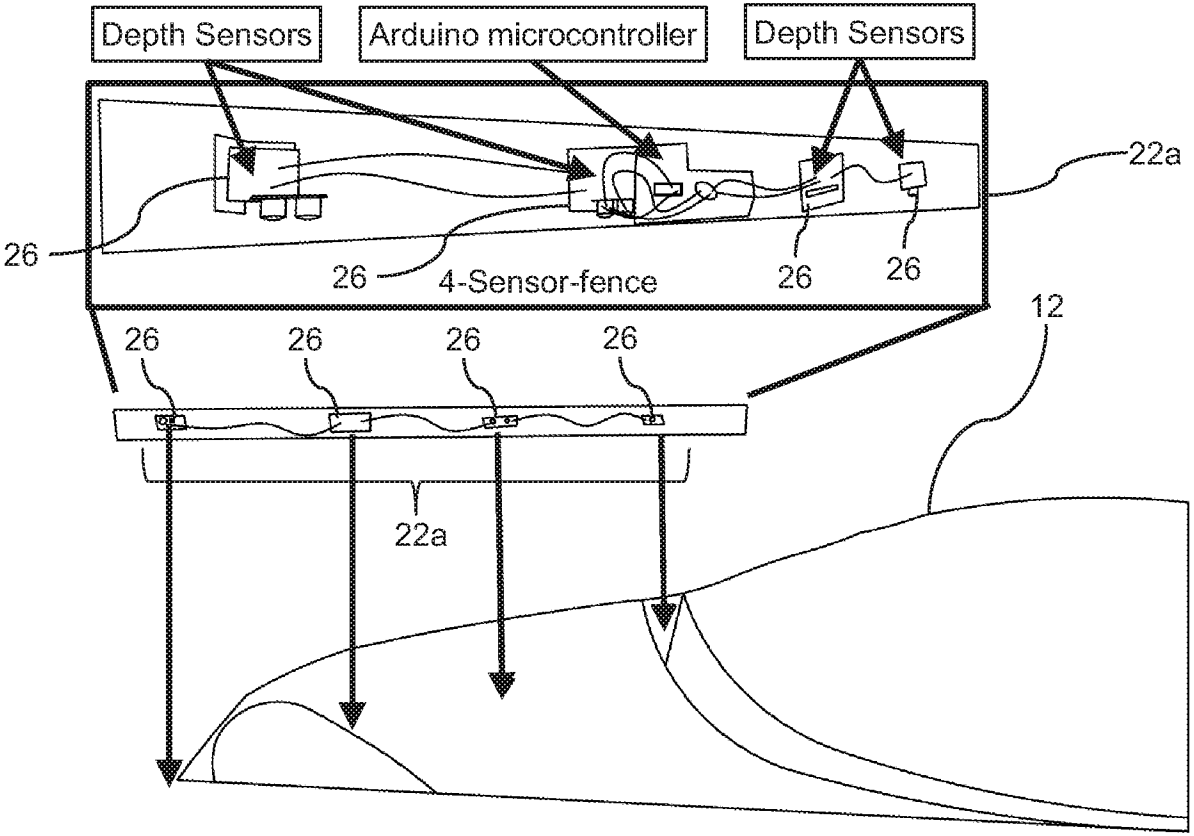
FIG. 13 shows an example of a sensor fence deployed with ultrasonic sensors.
Figure 16:
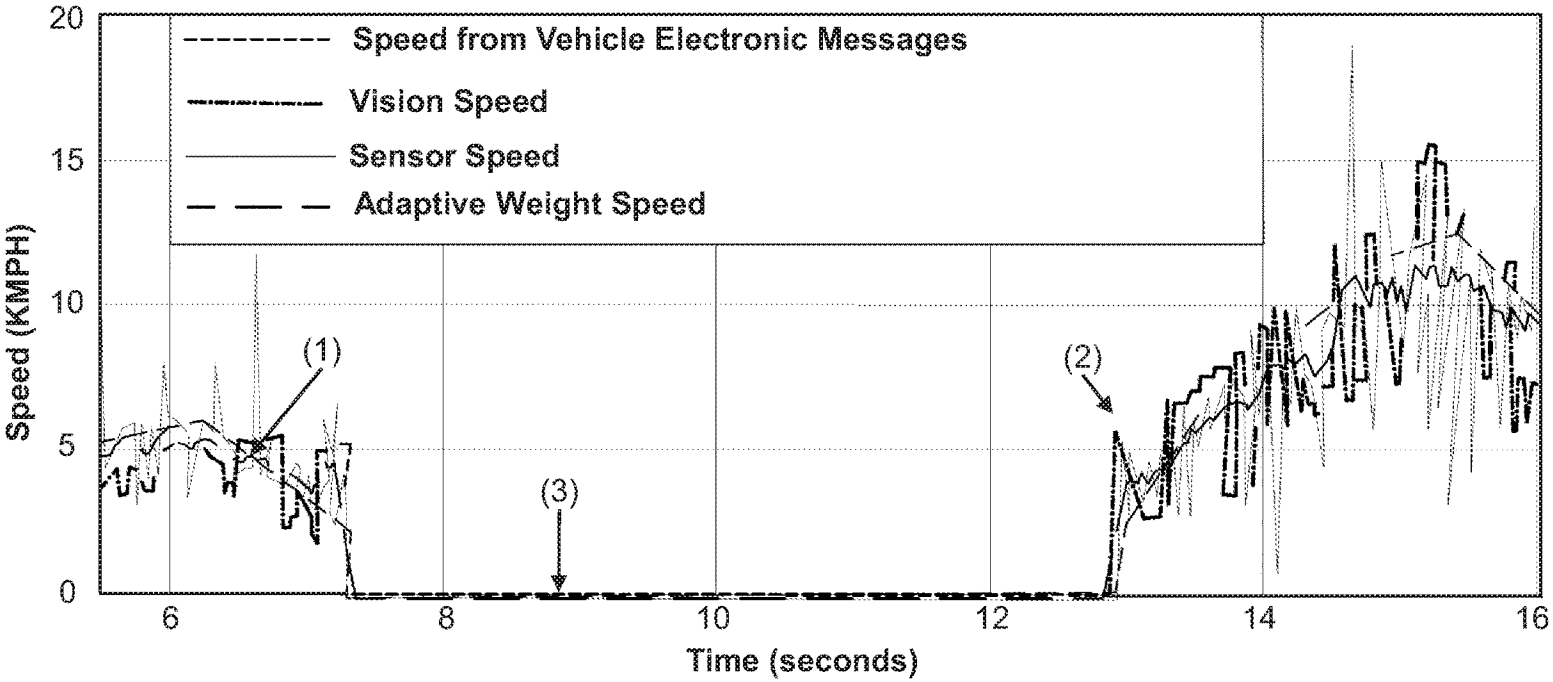
FIG. 16 shows a graph of a motion profile from vehicular electronic messages, sensor system, vision system, and adaptive-weight algorithm.

This section presents sensor fence construction, efficient implementation of control logic using micro-controllers and presents cost estimation for deployment. FIG. 13 shows an example of a sensor fence 22*a* deployed with ultrasonic sensors 26. The sensor array 22*a* is deployed using the four ultrasonic sensors 26, which are controlled by Arduino Yun (or Arduino) controller and mounted 2 meters above the ground as shown in FIG. 16. The inter-sensor distance is 30 cm and covers only 90 cm of the vehicle service station. Additional sensors can be used to cover longer lengths of the station. Sensor array 22*a* measures the depth at a constant rate of 1/20 second and the measurements are recorded by the Arduino. These depth measurements are processed by Arduino to produce motion signature. The Arduino processes measurements to obtain parameters such as slope of vehicle, velocity, etc. as describe above. The measured velocities along with parameters are sent to central server only when it has confirmed the vehicle's presence. This feature is enabled by recording the number of sensors 26 triggered at a given time instance. Other triggers (such as caused by a walking person) will usually not trigger all the sensors 26.

C. On-Vehicle Implementation

The speed of the vehicle 12 can be measured using several techniques as outlined below: Mobile communication device (e.g., smartphone) attached to dashboard and application installed for this purpose. Vehicles OBD-port connected to the mobile communication device. Custom made devices available in market that can be designed by connecting OBD-port and transmits motion signatures using Wi-Fi and can be configured by mobile phone or laptop. Large-scale production of the system might cost much lower than presented costs.

V. Evaluation

In this section the embodiments of the Soft-Swipe system 10 are implemented and evaluated. First, the individual vision system 22*b* and sensor systems 22*a* are evaluated for motion profile accuracy. Then, the adaptive weight algorithm is evaluated for error reduction. Finally, the matching algorithm is evaluated for matching accuracy, precision and rogue-vehicle detection.

A. Vision Performance

Some embodiments evaluate the system for the following parameter: real-speed-profile vs. measured speed-profile vs. different cameras. The embodiment for a vision system 22 is robust to background noise and estimated speed with one exemplary implementation achieving an overall standard deviation of 2 kmph and less than 0.5 kmph with large training set.

Figure 14:
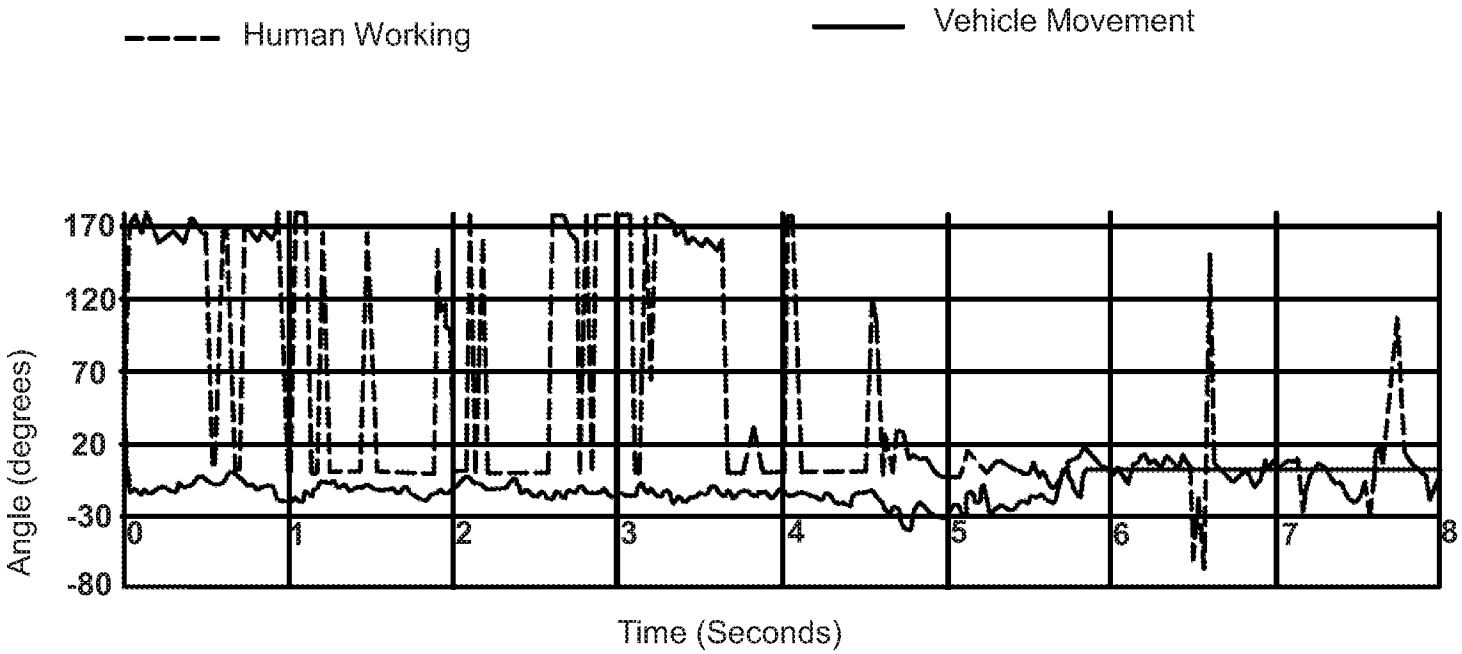
FIG. 14 is a graph showing direction of motion in a camera's field of view for a walking human and a vehicle coming into a lane.

The embodiments are background noise resistant. The optical flow vectors that are not in the direction of the vehicle's motion can be filtered out. The direction of motion of the vehicle 12 is learned during the training phase. In an implemented test, a person walking randomly in the lane 14 and a vehicle 12 moving through the lane 14 was used as an experiment. FIG. 14 is a graph showing direction of motion in a camera's field of view for a walking human and a vehicle 12 coming into a lane 14. The results shown in FIG. 14 clearly indicate that the patterns are distinct and thus the exemplary solution can tolerate background noise.

In implementing the vision system 22*b*, a variable accuracy can be achieved in speed sensing. Soft-Swipe 10 calibrates the pixel speed from raw-frames and converts this pixel speed to real-speed by multiplying with a scaling value. This scaling value is derived for each pixel position during initial training runs. Each training run provides scaling values for a few pixels in the frame. However, during system usage, vehicles might not light up exact same pixels in the frame. The closest pixel position with a known scaling value is used in that case.

Figure 15:
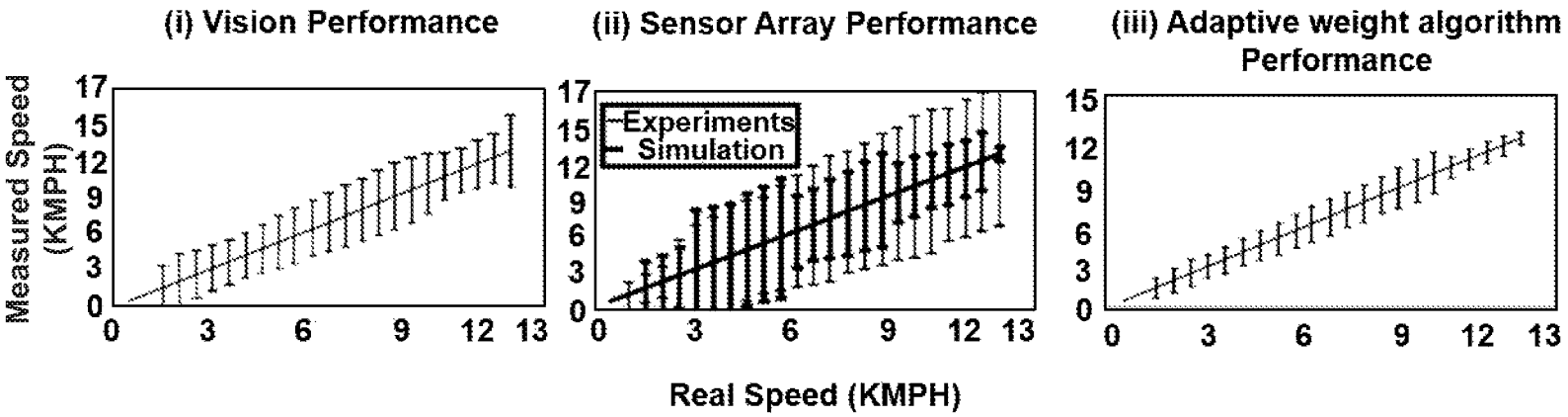
FIG. 15 shows three graphs of speed estimation variance plots of a vision system.

FIG. 15 shows three graphs of speed estimation variance plots of an exemplary implementation and testing of the vision system 22*b*. The graphs show speed estimation variance-plots of vision-system 22*b* (experiments) with average standard deviation 1.6 kmph, sensor-system 22*a* (simulation and experiments) with average variance of 2 kmph, and adaptive algorithm with average variance of 1 kmph from indoor low speed experiments. The adaptive weight algorithm combines sensor simulated results and vision results for estimating motion profile, which can reduce the error by more than 50% according to one implementation of the embodiments. FIG. 15(*i*) shows the velocity estimation accuracy for thirty vehicular runs with a few rounds of training. The overall standard deviation has 2 kmph and it is less than 0.5 kmph when the training set has the scaling values for the same pixel.

B. Sensor Fence Performance

In an exemplary implementation, a 4-sensor array was used for measuring speed measurement accuracy. FIG. 15(*ii*) (blue bars) plots the speed measurement accuracy. The results can be observed as the measurement error increased with the speed of measurement. To analyze the trend, the simulated sensor system can be simulated by feeding traces containing dimensions of different vehicles and vehicle mobility traces. FIG. 15(*ii*) (red bars) plots the accuracy obtained from simulation. Simulation results showed significant performance for higher velocities. This is due to a higher number of sensors are needed for capturing higher velocities. The sensor-fence 22*a* performance of the particular implementation can depend primarily on the angle of plane. But with limited number of sensors (in experimentation of 4 sensors), the chance of capturing higher-slope planes is less, compared to long chain of sensors (in simulation result). In addition, the higher the speed the faster the high-angular plane moves which makes difficult for few sensors to capture this plane. Whereas, with large number of sensors the high angular plane remains in sensor view for a long time. Additionally, the higher the speed, the more change in depth, which is less affected by measurement error (for example nearly 1 cm). Therefore, a number of sensors must be selected based on a targeted speed. Additionally, a higher number of sensors measures speed more accurately.

C. Adaptive Weight Algorithm Performance

In an implementation of the embodiments, it can be advantageous to combine the motion profiles obtained from the vision system 22*b* and sensor system 22*a* by using the Adaptive weight algorithm. FIG. 16 shows graphs of a motion profile from vehicular electronic messages, sensor system 22*a*, vision system 22*b*, and adaptive-weight algorithm 30.

The Adaptive weight algorithm 30 can produce less noisy and more accurate motion profile combining both vision and sensor array. Related art smoothing algorithms were tested as to whether they could reduce noise from vision 22*b* and sensor arrays 22*a*. However, these algorithms missed the sharp-peaks in motion profile (sudden stops, acceleration, etc.) and therefore are not suitable to dynamic vehicular speeds. Therefore, the Adaptive weight algorithm 30 gives motion profile with less Gaussian error.

Figure 19:
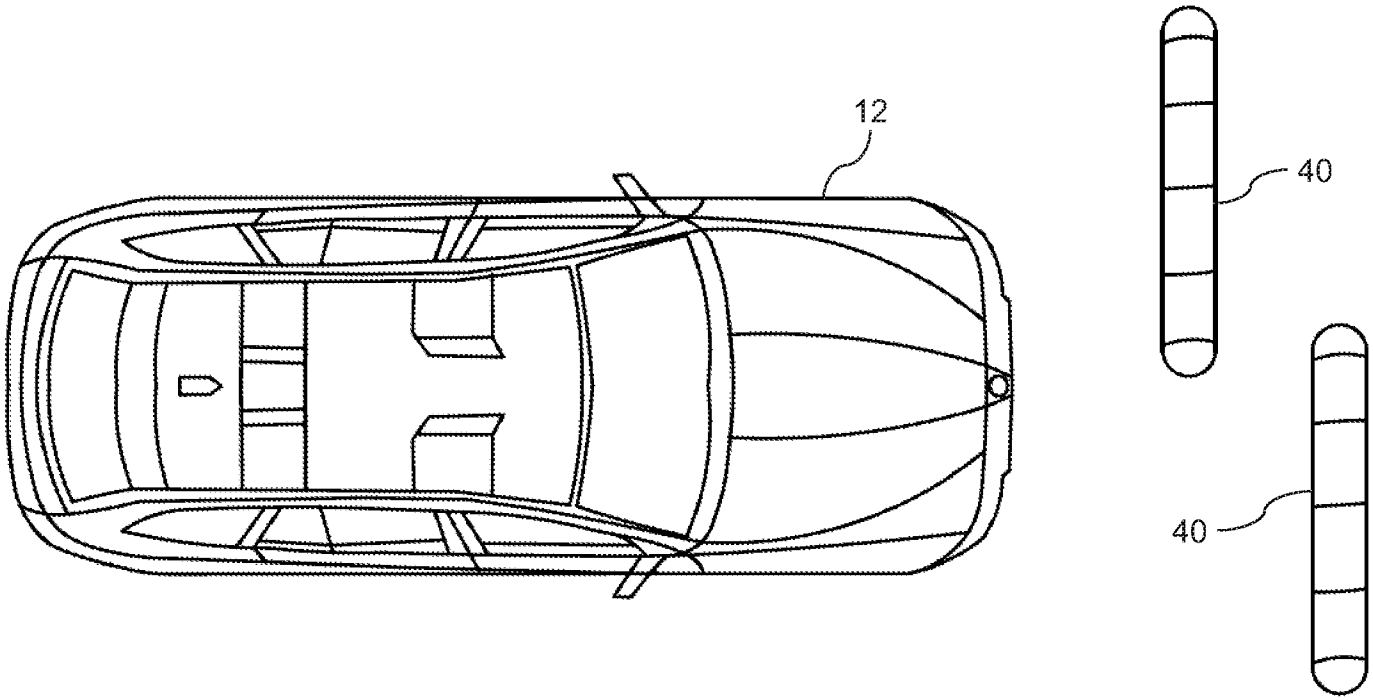
FIG. 19 shows an illustration of lane information encoded by using potholes planted on a roadway.

In an exemplary implementation, the AW speed was mainly dependent on the sensor array when the vehicle 12 is far from the camera 23*b*, as depicted in FIG. 19. This can be expected since the error-rate of vision increases with distance as per the study described above. In addition, a non-uniform error reduction of AW algorithm 30 on a sample basis can be achieved. This is mainly due to an independent relation between errors of both sensor 22*a* and vision systems 22*b*. The adaptive weight algorithm 30 will give accurate motion profile by giving more weight to accurate measurement. However, if both the measurements (sensor and vision) are erroneous, the adaptive weight algorithm 30 cannot give accurate measurements. This phenomenon can be observed for individual samples (when both are bad). But over a long motion signature, this phenomenon averages and makes the adaptive weight algorithm 30 more accurate. In the exemplary implementations used for a set of 30 experiments, the adaptive weight algorithm 30 reduced error by 50% (i.e. nearly 1 kmph) as compared to the vision system 22*b* and 55% (i.e. nearly 1.2 kmph) as shown in the FIG. 15(*iii*).

D. System Performance from Emulation

In this section, an embodiment of the Soft-Swipe system 10 is evaluated. First, the emulator designed for experimenting vehicle to infrastructure interaction is described. Then, metrics for evaluating vehicle to infrastructure communication are described. Finally, a thorough evaluation and analysis of these metrics are presented.

Some embodiments include a multi-lane discrete time emulator. Since building the system for multiple lanes and experimenting with many vehicles need infrastructure, an emulator was designed. This emulator uses single lane experimental traces and emulates a multi-lane experiment. Essentially, a large set of single lane experiments are performed. Then, in multi-lane emulation, a random experiment from this set is chosen for each lane 14 and replayed. This large single lane experiment set is constructed as follows. First, the experiments are performed in a single lane using a camera 23*b* and sensor-fence 22*a* and vehicle runs are performed for over 50 times. These vehicle runs are performed in an indoor vehicular station including different possible scenarios including, but not limited to, single-stop, multiple-stops, drive-through, etc. During these 50 experiments, data was collected from sensor-fence 22*a*, vision-system 22*b* and vehicular electronic messages. With this data, a set of 400 runs is generating by scaling all corresponding motion signatures by a random value chosen uniformly from 0.5 to 2. The scaling bounds (0.5 and 2) are chosen as per the speed limit for indoor parking lots which is less than 17 MPH or less in most of states. For every emulated run of a vehicle 12 a random sample is picked from this data-set. Then, the continuous vehicles motion in a lane is generated by concatenation multiple of these random-picks. The inter-vehicle arrival time is modeled by a Poisson process. Also, all corresponding motion signatures (camera 23*b*, sensor 26, and electronic-transmission) are concatenated with the same random value. At the end of this process, for each lane 14, a chain of motion-signatures is created in both observation and electronic domains. Additionally, the observation domain motion signatures are associated with corresponding error-variances. These observation domains can be merged using the adaptive-weight algorithm 30 to obtain a more accurate motion signature and it is given as input to the matching algorithm. The matching algorithm finds the weighted Euclidean distance between the observation motion signature and electronic motion signature and matches using a greedy algorithm by keeping confidence parameter c as 99.7% (3–σ distance).

To examine the benefits of the matching algorithm, the following metrics were evaluated. Precision and Recall: Precision gives a ratio of number of correct matches to total number of matches produced by Soft-Swipe. Recall gives the ratio of number of correct matches to the total number of correct matches. Miss-Rate: It is the probability of detecting an observation without electronic transmissions (rogue-vehicle). This metric is essential in toll based applications. False-stop: The probability that a match is not found by the Soft-Swipe algorithm 30 despite of having a match. Identity-Swap: The probability of swapping identity between two vehicles. This metric is essential for drive-through and other service based transactions as this metric quantifies the incidence of swapped transactions.

Figure 17:
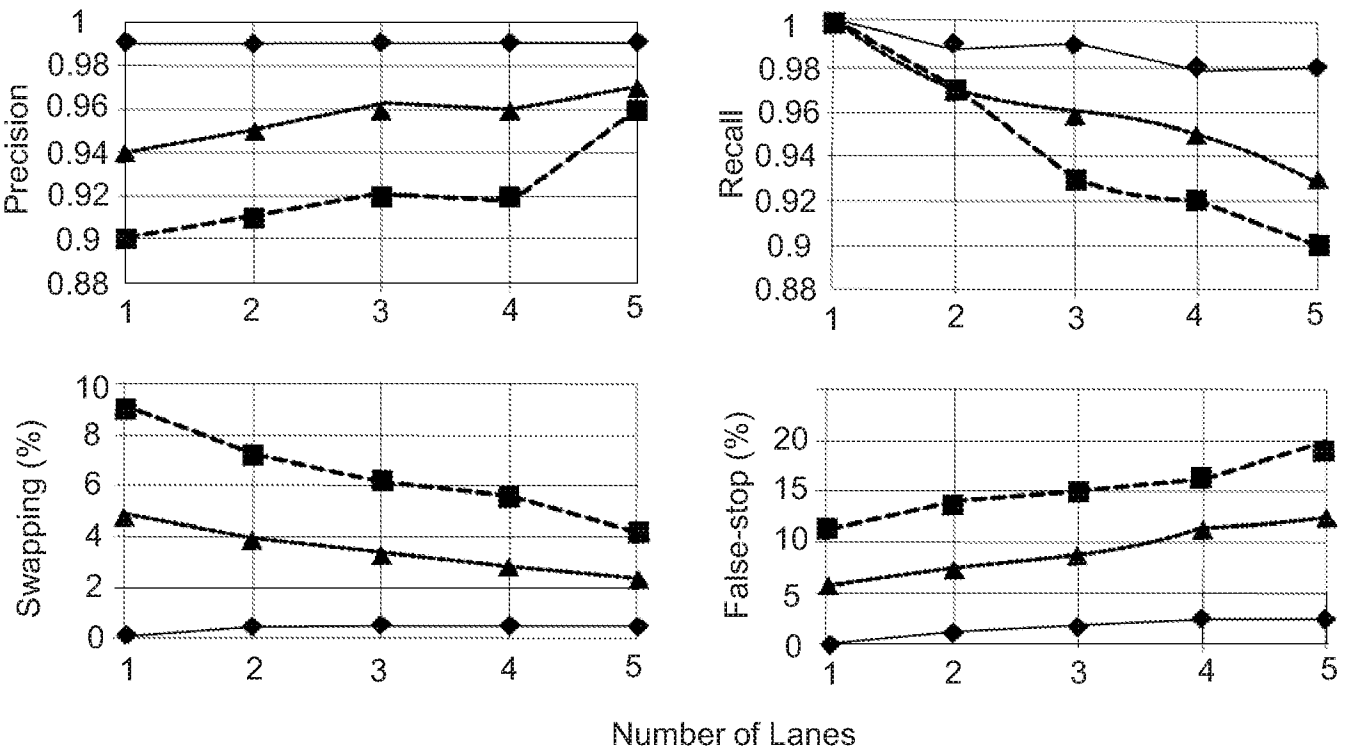
FIG. 17 shows a series of graphs matching results using sensor fence, vision, and the adaptive-weight algorithm using a weighted matching algorithm.

FIG. 17 shows a series of graphs matching results using sensor fence 22*a*, vision 22*b*, and the adaptive-weight algorithm 30 using a weighted matching algorithm. First, a multi-lane experiment was created using the embodiments with varying lane count ranging from 1 to 5. Additionally, the exemplary system receives motion profiles from seven exterior electronic transmissions (vehicles yet to enter the station but transmitting the motion profile). Then the system 10 is evaluated for above metrics as shown in the FIG. 17. For evaluating the miss rate, out of the vehicles 10 in the station, one vehicle is made rogue, where the rogue-vehicle does not transmit the motion profile. Then the system 10 is evaluated for detecting this rogue-vehicle.

Figure 18:
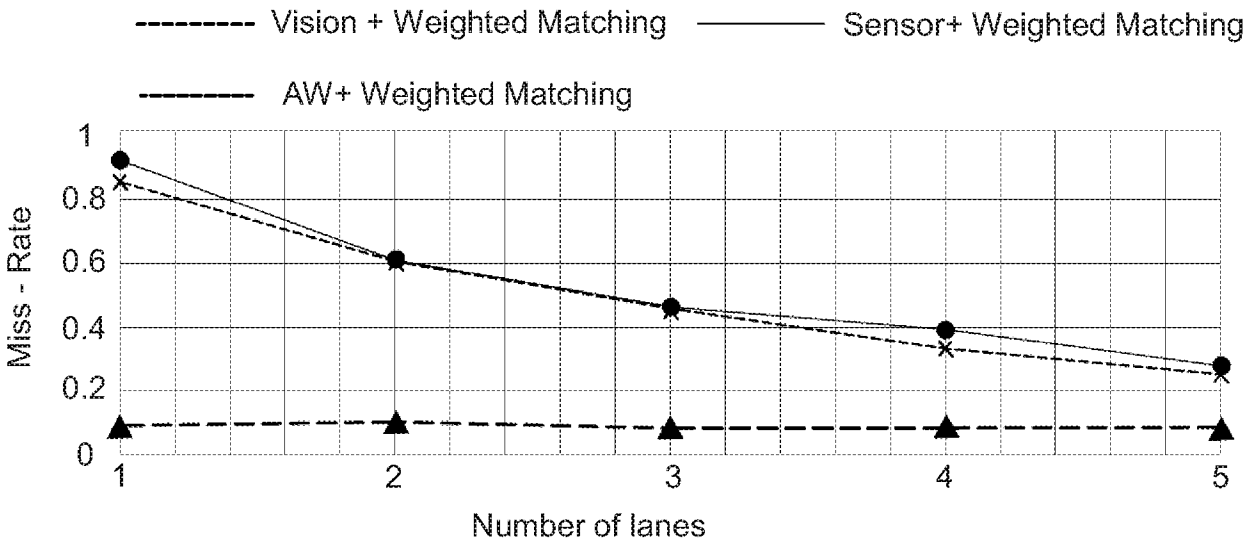
FIG. 18 shows a graph of the miss-rate comparison for the weighted matching algorithm using vision system, sensor system, Adaptive weight algorithms.

FIG. 18 shows the miss-rate comparison for the weighted matching algorithm 30 using vision system 22*b*, sensor system 22*a*, and adaptive weight algorithms 30. Different algorithms are evaluated for detecting miss-rate. Adaptive weight (AW)+weighted matching outperforms other matching algorithms and has miss-rate of less than 10%. From the above evaluation, the following general trends in the above mentioned algorithms can be made. Precision increased with number of lanes and swap-rate decreased with lanes. This trend in precision is mainly attributed to reduction in noise (noise-vehicle transmissions) per lane. Increase in precision rate also results in lower swapping rates. Recall-decreased with number of lanes and False-stops increased linearly with number of lanes. With more number of lanes, the fraction of noise-vehicles (vehicles yet to enter station) reduces leading more vehicles considered as match. Increase in Recall reduces the precision. When recall is high, the lower precision will result in some vehicles to be stopped for traditional processing (perhaps with manual intervention). AW+Weighted matching has motion-profile error margin ($\sigma_D$) of nearly 0.23 kmph whereas Vision+Weighted Matching and Sensor+Weighted Matching resulted in a large error margin of greater than 2 KMPH. Due to this, there is a higher chance that two motion profiles from different vehicles can be close for Vision+Weighted Matching and Sensor+Weighted Matching, leading to higher miss-rate.

The miss-rate can be reduced further by increasing the confidence (c) defined above, but this will reduce the recall leading to valid pairs being eliminated as a miss (rogue-vehicle). This means the lower the miss-rate implies a higher chance of valid vehicles being considered as a miss (rogue-vehicle). Also, by reducing the confidence c, recall can be increased, but this reduces the precision.

VI. Security Implications and Technologies

The embodiments and exemplary implementations of Soft-Swipe 10 can have security implications in enabling the vehicle with infrastructure communication. Also, lane-ID, the byproduct of Soft-Swipe 10, has implications in traffic routing.

Some embodiments can include systems and methods for software security. A directive of Soft-Swipe 10 is to enable vehicle infrastructure communication. In addition, Soft-Swipe 10 can counter the following attacks that are prevalent in other pairing mechanisms such as RF-ID based pairing. Replay Attack: Soft-Swipe 10 is resistant to replay attack, since the motion-signature of each vehicle is unique and distinct for each vehicular run. Man-In-The-Middle Attack (MITMA): In a given vehicular run even though the adversary can observe the motion-signature by employing a more powerful camera, he cannot make use of this signature. If the adversary broadcasts this observed signature (say, it belongs to Alice), he automatically pays for Alice. The only way an adversary can avoid transaction and will have gate-pass is to make Alice transmit his motion signature, which is not possible since it requires root access for Alice's phone.

Some embodiments can include traffic routing and indoor navigation. Soft-Swipe 10 can enable reliable vehicle to infrastructure pairing using commodity cameras and depth-sensors. Lane identity of the vehicle 12 is the byproduct of Soft-Swipe 10, which can be used in the following class of vehicle-routing and counting based applications. Road-intersection routing: Roadside security cameras can be made intelligent using Soft-Swipe and the vehicles at route-intersections can be routed to corresponding lanes. Also, the GPS navigation system is known for errors inside tunnels and under-bridges. Parking lot routing: Parking lot-availability and indoor-parking lot navigation based applications can make use of the map generated by Soft-Swipe.

VII. Summary and Advantages

Soft-Swipe 10 can perform secure NFC by exploiting the motion signatures of the object at a particular location. The embodiments can involve technologies relating to location signatures and vehicle sensing. Soft-Swipe 10 can enable secure reliable pairing between a vehicle 12 and the infrastructure by exploiting motion signatures of the vehicle 10 at a particular location. First, it is related to the general idea of location signatures. Second, it is related to techniques for sensing the location signature (motion signature). Finally, Soft-Swipe 10 is related to works in sensor-fusion.

A. Location Signatures

Location based signatures can be used in the context of NFC, wireless localization and wireless security. The ambient sensors available on the NFC equipped mobile phones, such as audio, light, GPS, and thermal can be used to create location specific signatures for authentication. Defined motion-signatures can be captured by inertial-sensors on mobile phones to provide indoor localization service. Wi-Fi RSSI can be used across different sub-carries to define location specific signatures for localization. The shape of RSSI of different sub-carries can be used to securely communicate.

Related art location based schemes may not be able to provide distinguishability between users in a location due to location signatures invariant of time. Wi-Fi based signatures are heavily time-varying in dynamic environments and difficult to sense. The motion-signatures captured by Soft-Swipe 10 can be time-varying, and can be sensed only by the vehicle and the NFC reader. These location-specific signatures can be captured in any environmental conditions, whereas approaches based on audio, light and thermal sensors are not applicable in certain environments.

B. Vehicle Speed Sensing and Matching:

The embodiments include a novel algorithm for dynamic speed estimation of the vehicle using both a vision 22*b* and depth sensor array 22*a*. The speed estimation algorithm from vision that is used in Soft-Swipe 10 is similar to works on speed estimation from road-side cameras. Soft-Swipe 10 can first estimate the shape of the moving object using a depth sensor array 22*a* that is hung from the ceiling, and then movement of this object across the sensor-array length is used to estimate the vehicle speed. Shape estimation of the vehicle 12 can be performed in a way that is similar to object construction from 3D points, however Soft-Swipe 10 exploits the 2-Dimensional nature of the speed estimation problem and involves a novel light-weight algorithm for shape and speed estimations. Related art approaches in speed estimation require a camera 23*b* to be trained with dimensions of the road and tilt angle, whereas the disclosed sensing approaches do not need training and the disclosed system dynamically captures the parameters. The disclosed secure communication algorithm benefits by sensing the vehicle 12 from the camera 23*b* (color, speed) to unicast with vehicles by matching E-V domains.

C. Sensor Fusion

The embodiments can use a machine learning based adaptive weight algorithm for fusing the individual sensor measurements. Related art methods have explored the adaptive weight algorithm by using variances of observations. However, these variances do not remain constant in the context of vehicular speed sensing based applications. Realizing this non-uniformity in the variances, the embodiments advantageously can use machine learning based Adaptive weight algorithm to combine motion signatures from multiple modalities.

VII. Alternative Embodiments

The following alternative embodiments relate to motion-signatures for enabling general pairing mechanisms in the context of vehicular communications.

A. Enhancing Motion Signatures for Intra-Vehicular Pairing

Soft-Swipe can exploit motion signatures to securely pair vehicles with the infrastructure. The alternative embodiment can be extended for pairing intra-vehicular systems in smart vehicles. Intra-vehicle systems can include, but are not limited to, multiple mobile phones, tablets, navigation system, cruise control, heating etc. These systems can continuously observe the motion profile, which can be used as a secret key to pair these systems. However, different systems measure the motion profile at different granularity, which makes generating long keys challenging. Additionally, the motion of phones and mobile devices inside a vehicle will distort the observed motion profiles.

B. Enhancing Motion Signatures with Vehicle Localization

Existing vehicle localization schemes can be used to enhance the performance of matching. Rather than matching all the lanes 14 with all the observed electronic identities, some of the electronic identities can be associated with particular location (lanes). This association can be performed using RSSI of Wi-Fi, Bluetooth, LE-scan or RF-IDs. However, this position is not accurate to localize a vehicle 12 to its respective lane, but it can be used to narrow down to a set of possible lanes 14 and thereby limit the possible matches.

C. Enhancing Motion Signatures with Tagging Infrastructure

The infrastructure can be tagged or planted efficiently to encode lane specific information. One simple mechanism to encode lane identity is by using potholes. This information can be observed by vehicles G-sensors in vehicles and can be used to identify a lane 14 and its corresponding position. FIG. 19 shows an illustration of lane information encoded by using potholes 40 planted on a roadway. These potholes 40 can be detected by sensors in the mobile communication devices to provide location information. Information encoding can be performed by using direction such as left-pothole, right-pothole, complete pothole etc. and using multiple of such potholes 40 as shown in FIG. 19. Additional mechanisms for infrastructure tagging can be used to obtain lane specific information. However, these techniques may need continuous maintenance and manual intervention.

While certain embodiments of the invention are described above, and FIGS. 1-19 disclose the best mode for practicing the various inventive aspects, it should be understood that the invention can be embodied and configured in many different ways without departing from the spirit and scope of the invention.

Embodiments are also intended to include or otherwise cover methods of using and methods of manufacturing any or all of the elements disclosed above. Various aspects of these methods can be performed with or otherwise cover processors and computer programs implemented by processors and memory containing executable instructions.

While the subject matter has been described in detail with reference to exemplary embodiments thereof, it will be apparent to one skilled in the art that various changes can be made, and equivalents employed, without departing from the scope of the invention. All related art references discussed in the above Background section are hereby incorporated by reference in their entirety.

What is claimed is:

1. A computer-assisted method for identifying a vehicle, comprising:

receiving, from a stationary sensor, sensor data representing a plurality of moving vehicles;

receiving, from a particular vehicle, a communication including sensor data representing the particular vehicle, wherein the sensor data includes at least one of velocity and position for the particular vehicle; and identifying, from the sensor data representing a plurality of moving vehicles, a subset of the data representing the particular vehicle, wherein identifying the subset of the data comprises analyzing the sensor data received from the stationary sensor in conjunction with the sensor data received from the particular vehicle.

2. The computer-assisted method for identifying a vehicle according to claim 1, wherein the first receiving step is accomplished through use of at least one of a vision sensor array and a depth sensor array to capture motion profiles of the plurality of moving vehicles.

3. The computer-assisted method for identifying a vehicle according to claim 2, further comprising calibrating the stationary sensor using motion profiles of moving vehicles captured by the at least one of the vision sensor array and the depth sensor array.

4. The computer-assisted method for identifying a vehicle according to claim 2, wherein the at least one of the vision sensor array and the depth sensor array is disposed above the moving vehicles and arranged parallel to a surface on which the moving vehicles are traveling.

5. The computer-assisted method for identifying a vehicle according to claim 2, wherein the at least one of the vision sensor array and the depth sensor array is a depth sensor array that is configured as ultra-sonic range sensors that can continuously measure depth to distinguish the vehicles and the surface on which the vehicles are traveling.

6. The computer-assisted method for identifying a vehicle according to claim 2, further comprising filtering out motion data from the sensor data representing a plurality of moving vehicles contrary to a direction of the plurality of moving vehicles to exclude extraneous movements from the sensor data.

7. The computer-assisted method for identifying a vehicle according to claim 1, further comprising determining whether the particular vehicle qualifies for a given operation to be performed thereon depending on identification of the vehicle from the subset of data.

8. The computer-assisted method for identifying a vehicle according to claim 7, further comprising performing the given operation on the particular vehicle once the vehicle has been determined to qualify for the operation based on identification.

9. The computer-assisted method for identifying a vehicle according to claim 1, wherein the first receiving step is accomplished through use of a vision sensor array and a depth sensor array in combination to capture motion profiles of the plurality of moving vehicles.

10. The computer-assisted method for identifying a vehicle according to claim 9, wherein sensor data representing a plurality of moving vehicles from each of the vision sensor array and the depth sensor array is adaptively weighted based on external factors affecting performance of each individual sensor array to capture motion profiles of the plurality of moving vehicles.

11. A computer-assisted method for identifying a vehicle in a vehicle manufacturing lane, comprising:

receiving, from a sensor array, real-time sensor array data representing a plurality of vehicle manufacturing lanes;

identifying, from the real-time sensor array data, a plurality of vehicles within the vehicle manufacturing lanes;

receiving, from a particular vehicle, a communication including vehicle sensor data representing the particular vehicle and registration data identifying the particular vehicle, wherein the vehicle sensor data includes at least one of velocity and position for the particular vehicle;

estimating movement data for each of the plurality of vehicles from the real-time sensor array data of the vehicle manufacturing lanes;

associating a vehicle of the plurality of vehicles identified from the sensor array data with the registration data identifying the particular vehicle based on comparing the estimated movement data to the vehicle sensor data representing the particular vehicle; and associating a particular vehicle manufacturing lane with the registration data based on the vehicle identified from the sensor array data being associated with the registration data.

12. The computer-assisted method for identifying a vehicle in a vehicle manufacturing lane according to claim 11, further comprising determining whether the particular vehicle qualifies for a given operation to be performed thereon depending on association of the vehicle with the particular vehicle manufacturing lane.

13. The computer-assisted method for identifying a vehicle in a vehicle manufacturing lane according to claim 12, wherein the sensor array comprises a camera;

wherein the real-time sensor array data comprises a plurality of images; and wherein identifying a plurality of vehicles comprises identifying a plurality of vehicle images within the plurality of images.

14. The computer-assisted method for identifying a vehicle in a vehicle manufacturing lane according to claim 13, further comprising identifying readily discernible features of the particular vehicle in the plurality of vehicle images.

15. The computer-assisted method for identifying a vehicle in a vehicle manufacturing lane according to claim 14, further comprising analyzing movement of the discernible features of the particular vehicle across the plurality of vehicle images to determine movement of the particular vehicle in the vehicle manufacturing lane.

16. The computer-assisted method for identifying a vehicle in a vehicle manufacturing lane according to claim 15, further comprising filtering out movement data contrary to a direction of the plurality of moving vehicles to exclude extraneous movements from the estimated movement data.

17. The computer-assisted method for identifying a vehicle in a vehicle manufacturing lane according to claim 16, further comprising calibrating the camera using motion profiles created from analyzing and determining movement of the particular vehicle from the plurality of vehicle images captured by the camera.

18. The computer-assisted method for identifying a vehicle in a vehicle manufacturing lane according to claim 17, further comprising filtering out movement data having smaller magnitudes than a threshold determined in the calibrating step.

19. The computer-assisted method for identifying a vehicle in a vehicle manufacturing lane according to claim 12, further comprising performing the given operation on the particular vehicle once the vehicle has been determined to qualify for the operation based on association.

20. A vehicle identification system for use with a plurality of vehicles each having a dynamic sensor therein, the dynamic sensors configured to record and transmit dynamic sensor data including at least one of velocity and position of the vehicle, the vehicle identification system comprising:

a stationary sensor configured to record and transmit stationary sensor data representing each of the plurality of moving vehicles; and a processor configured to receive the dynamic sensor data from the dynamic sensor in each of the plurality of vehicles and the stationary sensor data of each of the plurality of vehicles from the stationary sensor, and identify subset of data representing a particular vehicle from the plurality of vehicles by analyzing and matching the dynamic sensor data and the stationary sensor data of the particular vehicle.

* * * * *